US008863654B2

(12) United States Patent
Asami et al.

(10) Patent No.: US 8,863,654 B2
(45) Date of Patent: Oct. 21, 2014

(54) COOKING DEVICE

(75) Inventors: Shinji Asami, Osaka (JP); Takashi Utsumi, Osaka (JP); Shinya Ueda, Osaka (JP); Hiroyuki Kato, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 162 days.

(21) Appl. No.: 13/387,568

(22) PCT Filed: Jul. 30, 2010

(86) PCT No.: PCT/JP2010/062875

§ 371 (c)(1),
(2), (4) Date: Jan. 27, 2012

(87) PCT Pub. No.: WO2011/013787

PCT Pub. Date: Feb. 3, 2011

(65) Prior Publication Data

US 2012/0118279 A1 May 17, 2012

(30) Foreign Application Priority Data

Jul. 30, 2009 (JP) ..... 2009-177835
Nov. 11, 2009 (JP) ..... 2009-257862

(51) Int. Cl.

| | |
|---|---|
| ***A23F 3/12*** | (2006.01) |
| ***A47J 37/06*** | (2006.01) |
| ***A47J 37/08*** | (2006.01) |
| ***A47J 27/00*** | (2006.01) |
| ***A23B 4/052*** | (2006.01) |
| ***A47J 37/07*** | (2006.01) |
| ***H05B 6/50*** | (2006.01) |
| ***A21B 1/00*** | (2006.01) |
| ***H05B 3/68*** | (2006.01) |
| ***H05B 6/80*** | (2006.01) |
| ***H05B 6/64*** | (2006.01) |
| ***F24C 1/14*** | (2006.01) |
| ***F24C 15/20*** | (2006.01) |

(52) U.S. Cl.
CPC ..... *F24C 15/2007* (2013.01)
USPC ..... 99/469; 99/375; 99/391; 99/392; 99/393; 99/399; 99/400; 99/444; 99/324; 99/352; 99/339; 99/446; 99/340; 219/705; 219/400; 219/450.1; 219/707; 219/730; 219/401; 219/731; 219/682; 126/6

(58) Field of Classification Search
USPC ..... 99/375, 391, 392, 393, 399, 400, 444; 126/344–363.1; 426/506–511; 219/620–627
See application file for complete search history.

(56) References Cited

U.S. PATENT DOCUMENTS 2,097,793 A * 11/1937 Howell ..... 99/446
2,220,414 A * 11/1940 Kritzer ..... 126/6

(Continued)

FOREIGN PATENT DOCUMENTS

JP 55-87415 U 6/1980
JP 7-133932 A 5/1995

(Continued)

OTHER PUBLICATIONS

International Search Report issued in PCT/JP2010/062875, dated Aug. 24, 2010.

*Primary Examiner* — Dana Ross
*Assistant Examiner* — Gyounghyun Bae
(74) *Attorney, Agent, or Firm* — Birch, Stewart, Kolasch & Birch, LLP

(57) ABSTRACT

A cooking device has a casing 1, a heating chamber 8 provided in the casing 1, an exhaust tube 18 for guiding exhaust from inside of the heating chamber 8 through an electric component chamber 9 in the casing 1 to front face side, and a dew receiving container 4 that is provided on front face side of the casing 1 and that receives and diffuses the exhaust from the exhaust tube 18 to outside of the casing 1.

11 Claims, 31 Drawing Sheets

(56) References Cited

U.S. PATENT DOCUMENTS

| | | | | | |
|---|---|---|---|---|---|
| 2,380,428 | A | * | 7/1945 | Gilliam | 99/476 |
| 3,212,426 | A | * | 10/1965 | Lewus | 99/339 |
| 3,456,578 | A | * | 7/1969 | Pinsly | 99/339 |
| 4,068,572 | A | * | 1/1978 | Vogt | 99/447 |
| 4,728,762 | A | * | 3/1988 | Roth et al. | 219/730 |
| 4,810,856 | A | * | 3/1989 | Jovanovic | 219/401 |
| 4,920,251 | A | * | 4/1990 | Whitenack et al. | 219/401 |
| 5,359,923 | A | * | 11/1994 | Boswell | 99/340 |
| 5,558,797 | A | * | 9/1996 | Takagi | 219/705 |
| 5,558,798 | A | * | 9/1996 | Tsai | 219/731 |
| 5,603,255 | A | * | 2/1997 | Nouvelot et al. | 99/400 |
| 6,019,033 | A | * | 2/2000 | Wilson et al. | 99/470 |
| 6,023,051 | A | * | 2/2000 | Fellows | 219/450.1 |
| 6,573,479 | B2 | * | 6/2003 | Arntz et al. | 219/400 |
| 6,670,591 | B2 | * | 12/2003 | Shon et al. | 219/707 |
| 6,730,895 | B2 | * | 5/2004 | Kim | 219/682 |
| 7,156,087 | B1 | * | 1/2007 | Churchill et al. | 126/25 R |
| 2006/0011071 | A1 | * | 1/2006 | Cho et al. | 99/417 |
| 2007/0163567 | A1 | * | 7/2007 | Kaneko et al. | 126/21 A |
| 2007/0227364 | A1 | * | 10/2007 | Andoh et al. | 99/324 |
| 2008/0223352 | A1 | * | 9/2008 | Ando et al. | 126/20 |
| 2008/0229936 | A1 | * | 9/2008 | Kaneko et al. | 99/357 |
| 2008/0292761 | A1 | * | 11/2008 | Baratin et al. | 426/510 |
| 2009/0007797 | A1 | * | 1/2009 | Ando et al. | 99/330 |
| 2009/0007798 | A1 | * | 1/2009 | Yamaguchi et al. | 99/330 |
| 2009/0038481 | A1 | * | 2/2009 | Yamamoto et al. | 99/330 |
| 2010/0064902 | A1 | * | 3/2010 | Sakane et al. | 99/352 |

FOREIGN PATENT DOCUMENTS

| | | | | |
|---|---|---|---|---|
| JP | 2002-213747 | A | | 7/2002 |
| JP | 2007-3150 | A | | 1/2007 |
| JP | 2008-116094 | | * | 5/2008 |
| JP | 2008-116094 | A | | 5/2008 |

* cited by examiner

COOKING DEVICE

TECHNICAL FIELD

The present invention relates to a cooking device.

BACKGROUND ART

There has been a conventional cooking device that performs heat cooking with use of steam (see JP 2008-116094 A (Patent Literature 1), for instance).

In the cooking device having the above configuration, exhaust from a heating chamber is diluted by being mixed with air in a room so that a temperature of the exhaust is decreased, and is then discharged from rear face side and top side toward front face side of a device body. On condition that there are wall surfaces in vicinity of the rear face side of the cooking device body, shelves just thereover, and/or the like, corrosion, dense growth of mold and/or the like are thereby prevented that may be caused on the wall surfaces, shelves and/or the like by contact therewith of highly heated exhaust containing steam.

There has been a demand that such a cooking device be placed and used in a rack, shelf or the like that requires further restrictions on the height, width and depth of the device, while there is difficulty in placement in a narrow space of the structure in which exhaust in the chamber is discharged from the rear face side toward the front face side of the device body, in particular, for the cooking device that performs cooking with use of steam.

CITATION LIST

Patent Literature

PATENT LITERATURE 1: JP 2008-116094 A

SUMMARY OF INVENTION

Technical Problem

An object of the invention is to provide a cooking device that is capable of disposing of exhaust from a heating chamber without discharging the exhaust from rear face side thereof even when being placed in a narrow space.

Solution to Problem

In order to achieve the object, a cooking device of the invention comprises:

a casing, a heating chamber that is provided in the casing and that has an opening on a front face thereof, an exhaust path for guiding exhaust from inside of the heating chamber through inside of the casing to front face side of the casing, and a dew receiving container that is placed under the opening of the heating chamber, that receives the exhaust from an exhaust exit of the exhaust path, and that diffuses the exhaust to outside of the casing.

When the heating chamber is increased in temperature and is filled with steam, smoke and/or the like produced from heated food in heat cooking of the food put in the heating chamber, according to the configuration, the exhaust from the inside of the heating chamber is guided by the exhaust path through the inside of the casing to the front face side. By the dew receiving container that is placed under the opening of the heating chamber, the exhaust from the exhaust exit of the exhaust path is received and diffused to outside of the casing. Then the highly heated exhaust containing steam from the inside of the heating chamber has been cooled when passing through the inside of the casing, so that the cooled exhaust having a decreased temperature can be received by the dew receiving container on the front face side and can be diffused to vast outside space on the front face side of the casing.

On condition that there are wall surfaces in vicinity of the rear face side of the cooking device body, shelves just thereover, and/or the like, corrosion, dense growth of mold and/or the like are thereby prevented that may be caused on the wall surfaces, shelves and/or the like by contact therewith of the highly heated exhaust containing steam, because exhaust in the chamber is not discharged from the rear face side of the body. Under condition of the placement in a narrow space, accordingly, the exhaust from the inside of the heating chamber can be disposed without being discharged from the rear face side.

Means for heating and cooking an object to be heated in the heating chamber is not limited to heating by a heater and may be heat cooking including steam cooking with use of steam and the like or may be heat cooking with use of superheated steam having a temperature not lower than 100° C.

A cooking device in accordance with an embodiment further comprises:

a cooling fan for cooling at least electric components in the casing, wherein cooling air blow-off openings through which a portion of cooling air from the cooling fan is blown off toward a region in the dew receiving container that receives and diffuses the exhaust from the exhaust exit of the exhaust path are provided on bottom part and the front face side of the casing.

According to the embodiment, the portion of the cooling air from the cooling fan for cooling at least the electric components in the casing is blown off through the cooling air blow-off openings provided on the bottom part and the front face side of the casing toward the region in the dew receiving container that receives and diffuses the exhaust from the exhaust exit of the exhaust path, and the exhaust blown off from the exhaust exit of the exhaust path into the dew receiving container that is placed under the opening of the heating chamber is thereby diluted with the portion of the cooling air while diffusion thereof is promoted, so that the exhaust can efficiently be diffused to the vast outside space on the front face side of the casing.

In the cooking device in accordance with an embodiment, cooling air guiding parts for guiding the cooling air, blown off from the cooling air blow-off openings provided on the bottom part and the front face side on the casing, toward the region in the dew receiving container that receives and diffuses the exhaust from the exhaust exit of the exhaust path are provided in the cooling air blow-off openings.

According to the embodiment, the cooling air blown off through the cooling air blow-off openings provided on the bottom part and the front face side of the casing is guided by the cooling air guiding parts provided in the cooling air blow-off openings toward the region in the dew receiving container that receives and diffuses the exhaust from the exhaust exit of the exhaust path, so that the exhaust blown off from the exhaust exit of the exhaust path into the dew receiving container can efficiently be diluted and diffused.

A cooking device in accordance with an embodiment further comprises:

a door that is provided on the front face side of the casing and that opens or closes the opening of the heating chamber by pivoting on either one of left and right side end parts of the casing, wherein the dew receiving container receives the exhaust from the exhaust exit of the exhaust path on either one of left and right sides of the casing where a pivoting center of the door exists, and wherein the cooling air blown off from the cooling air blow-off openings provided on the bottom part and the front face side on the casing is blown off toward either one of the left and right sides of the casing where the pivoting center of the door exists.

According to the embodiment, the cooling air blown off through the cooling air blow-off openings provided on the bottom part and the front face side of the casing is blown off toward either one of the left and right sides of the casing where the pivoting center of the door exists, while the dew receiving container receives the exhaust from the exhaust exit of the exhaust path on either one of the left and right sides of the casing where the center of pivoting of the door exists, and thus a hand that grasps the door being opened is opposed to the center of pivoting of the door, so that the hand that grasps the door is prevented from being exposed to the exhaust diffused by the dew receiving container.

In the cooking device in accordance with an embodiment, a cooling air guiding wall for guiding the cooling air, blown off from the cooling air blow-off openings provided on the bottom part and the front face side of the casing, toward the region in the dew receiving container that receives and diffuses the exhaust from the exhaust exit of the exhaust path is provided in the dew receiving container.

According to the embodiment, the cooling air from blown off through the cooling air blow-off openings provided on the bottom part and the front face side of the casing is guided by the cooling air guiding wall provided in the dew receiving container toward the region in the dew receiving container that receives and diffuses the exhaust from the exhaust exit of the exhaust path, and thus the exhaust blown off from the exhaust exit of the exhaust path into the dew receiving container can efficiently be diluted with and diffused by the portion of the cooling air.

A the cooking device in accordance with an embodiment further comprises:

an exhaust duct that is provided on an exhaust exit side in the exhaust path in the casing and that mixes the exhaust from the inside of the heating chamber with the portion of the cooling air from the cooling fan and discharges the exhaust into the dew receiving container.

According to the embodiment, the exhaust from the inside of the heating chamber is mixed with the other portion of the cooling air from the cooling fan and is discharged into the dew receiving container by the exhaust duct that is provided on the exhaust exit side in the exhaust path in the casing, and thus the dilution of the exhaust and the decrease in the temperature of the exhaust can efficiently be attained with the utilization of the cooling air from the cooling fan for cooling the electric components.

In the cooking device in accordance with an embodiment, the exhaust path guides the exhaust from the inside of the heating chamber through a cooling space in the casing to the front face side.

According to the embodiment, the exhaust from the inside of the heating chamber is guided by the exhaust path through the cooling space in the casing to the front face side, and thus a path length of the exhaust path can be increased, so that cooling efficiency can be increased by the extension of the path running through the cooling space.

In the cooking device in accordance with an embodiment, the exhaust path guides the exhaust from rear part of the heating chamber to the front face side.

Herein, "rear side" of the heating chamber refers to part of the heating chamber that is at rear of a center thereof with respect to frontward and rearward directions.

According to the embodiment, the exhaust from the inside of the heating chamber is guided by the exhaust path from the rear part of the heating chamber to the front face side, and thus the path length of the exhaust path can be increased, so that the cooling efficiency can be increased by the extension of the path running through the cooling space. Thus the temperature of the exhaust diffused to the outside of the casing by the dew receiving container can further be decreased.

In the cooking device in accordance with an embodiment, the exhaust path is inclined from the rear part toward the front face side of the casing and from upper side of the rear part toward lower side of the front face side of the casing.

By the inclination of the exhaust path from the rear part of the heating chamber toward the front face side and from the upper side of the rear part toward the lower side of the front face side of the heating chamber, according to the embodiment, increase in the length of the path running through the cooling space and improvement in the cooling efficiency are attained and condensate water that may be produced by cooling of the highly heated exhaust containing steam in the cooling space may be made to flow down through the exhaust path toward downstream side. This prevents stagnation of the condensate water in the exhaust path, impediment against flow of the exhaust, and unsanitary condition in the exhaust path.

In the cooking device in accordance with an embodiment, the cooling space is provided so as to extend from a lateral side and the rear face side of the heating chamber to the front face side in the casing, and wherein the exhaust path guides the exhaust from vicinity of the rear part of the heating chamber toward the front face side and the outside in the cooling space.

According to the embodiment, the exhaust path guides the exhaust from the vicinity of the rear part of the heating chamber toward the front face side and the outside in the cooling space that is provided so as to extend from the lateral side and the rear face side of the heating chamber to the front face side thereof in the casing, and thus the path length of the exhaust path can be increased, so that the cooling efficiency can be increased by the extension of the path running through the cooling space, and so that the temperature of the exhaust diffused to the outside of the casing by the dew receiving container can further be decreased.

A cooking device in accordance with an embodiment further comprises:

an exhaust duct provided in the casing and on a front face side in a cooling space, and a cooling fan for cooling at least electric components in the cooling space, wherein the exhaust duct comprises a blow-in opening, provided on upstream side thereof, into which a portion of cooling air from the cooling fan is blown, and a discharge port, provided on downstream side thereof, through which the cooling air blown in through the blow-in opening is discharged, wherein the exhaust exit of the exhaust path is provided in an air path between the blow-in opening and the discharge port, and wherein the exhaust from the exhaust exit of the exhaust path is received by the dew receiving container through the discharge port of the exhaust duct.

According to the embodiment, the portion of the cooling air from the cooling fan for cooling the electric components is blown into the blow-in opening provided on the upstream side in the exhaust duct provided in the casing and on the front face side in the cooling space. The cooling air blown in through the blow-in opening of the exhaust duct is discharged through the discharge port provided on the downstream side in the exhaust duct. Then the exhaust flows into the exhaust duct through the exhaust exit of the exhaust path placed in the air path between the blow-in opening and the discharge ports in the exhaust duct and is mixed with the cooling air, so that the exhaust diluted by mixing with the cooling air is discharged through the discharge ports of the exhaust duct. With such utilization of the cooling air from the cooling fan for cooling the electric components, the temperature of the exhaust can be decreased by the dilution of the exhaust, and the exhaust from the inside of the heating chamber can efficiently be discharged by smoothing of the exhaust flow by way of the exhaust duct.

A cooking device in accordance with an embodiment comprises:

a door that is openably and closably provided on a front face of the casing and that opens or closes the opening of the heating chamber, wherein the dew receiving container receives waterdrops dropping from the front face of the casing.

According to the embodiment, the dew receiving container has both a function of receiving dew and a function of receiving and diffusing the exhaust and thereby makes it possible to simplify a structure of the device and to reduce manufacturing cost, cost of components and the like therefor.

Advantageous Effects of Invention

According to the cooking device of the invention, as apparent from the above, the cooking device can be provided that is capable of disposing the exhaust from the inside of the heating chamber without discharging the exhaust from the rear face side thereof even when being placed in a narrow space.

DESCRIPTION OF EMBODIMENTS

Figure 1:
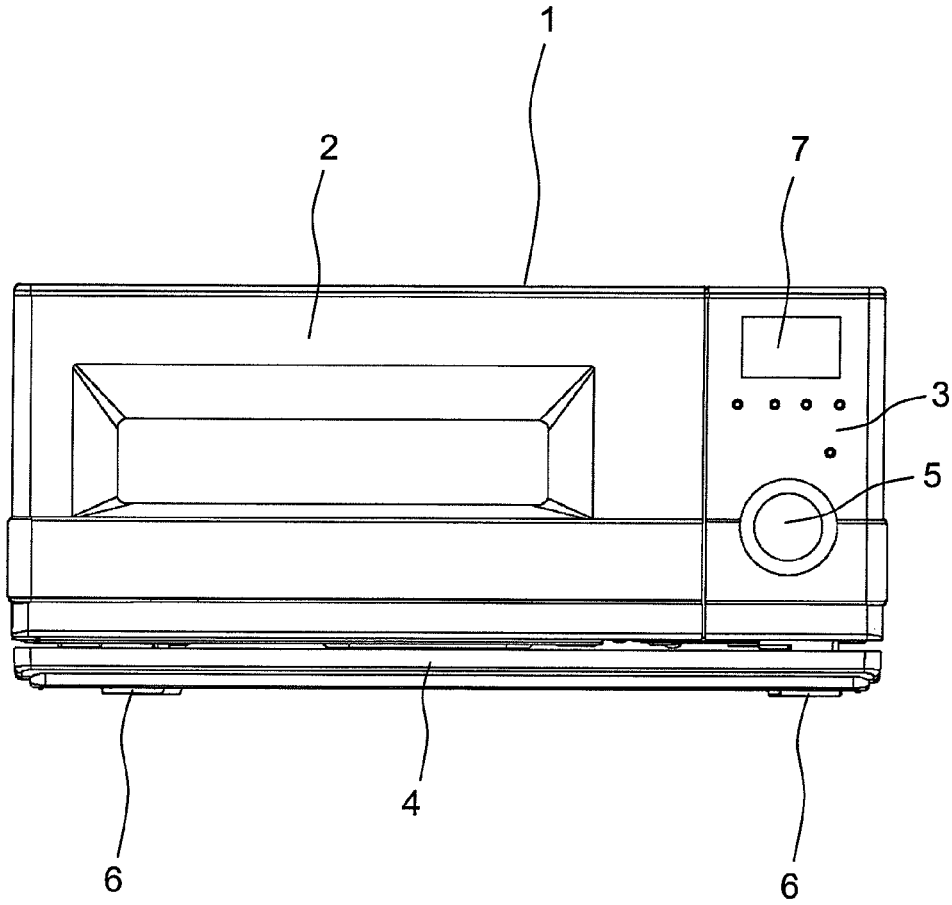
FIG. 1 is a front view of a cooking device in accordance with a first embodiment of the invention.

Hereinbelow, a cooking device of the invention will be described in detail with reference to embodiments shown in the drawings.

First Embodiment

FIG. 1 is a front view of a cooking device in accordance with a first embodiment of the invention.

As shown in FIG. 1, the cooking device has a casing 1, and a door 2 with handle, as an example of a door of slide opening/closing type, that is mounted on front face side of the casing 1. An operation panel 3 is provided on the front face side of the casing 1 so as to adjoin the door 2 with handle that is closed. A dew receiving container 4 as an example of an exhaust receiving part is provided under the door 2 with handle and the operation panel 3.

A generally cylindrical dial 5 is rotatably mounted on the operation panel 3. The operation panel 3 has a liquid crystal display part 7, which provides displays according to operations of the dial 5.

The dew receiving container 4 is a container that is attachable to and detachable from two front legs 6, 6 provided on front side on bottom part of the casing 1. Once the dew receiving container 4 is inserted to underside of the casing 1 from front side toward rear side and is mounted on the front legs 6, 6, a portion of the dew receiving container 4 is positioned under a rear face (back face) of the door 2 with handle that is closed. Thus condensate water deposited on the rear face of the door 2 with handle drops into the dew receiving container 4 placed under an opening 8*a* (shown in FIG. 2B) of the heating chamber 8 (shown in FIG. 2B) when the door 2 with handle is opened.

Figure 2A:
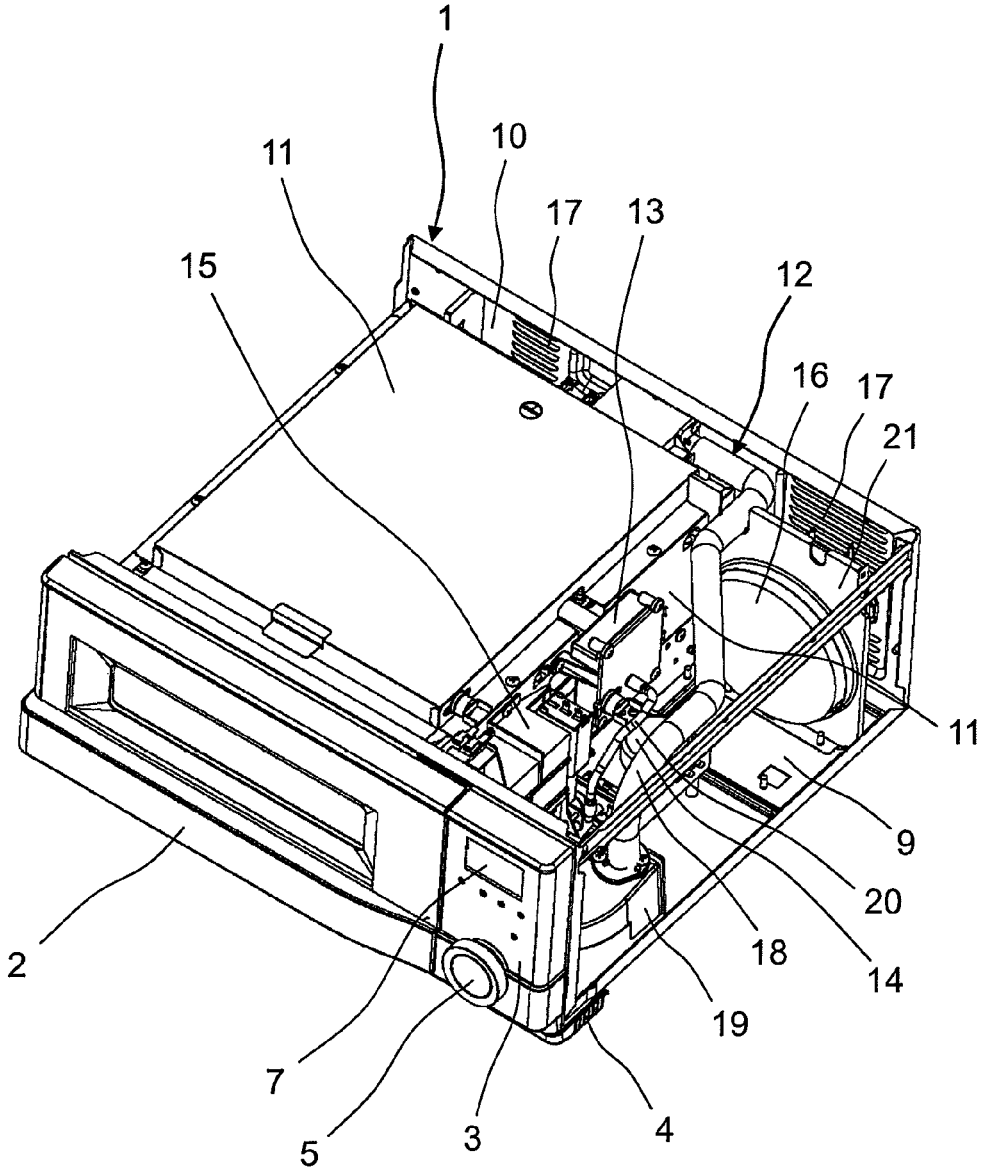
FIG. 2A is a perspective view of the cooking device, from which a top part and both side parts of a casing are removed, as seen looking from front and diagonal upper side thereof.
Figure 2B:
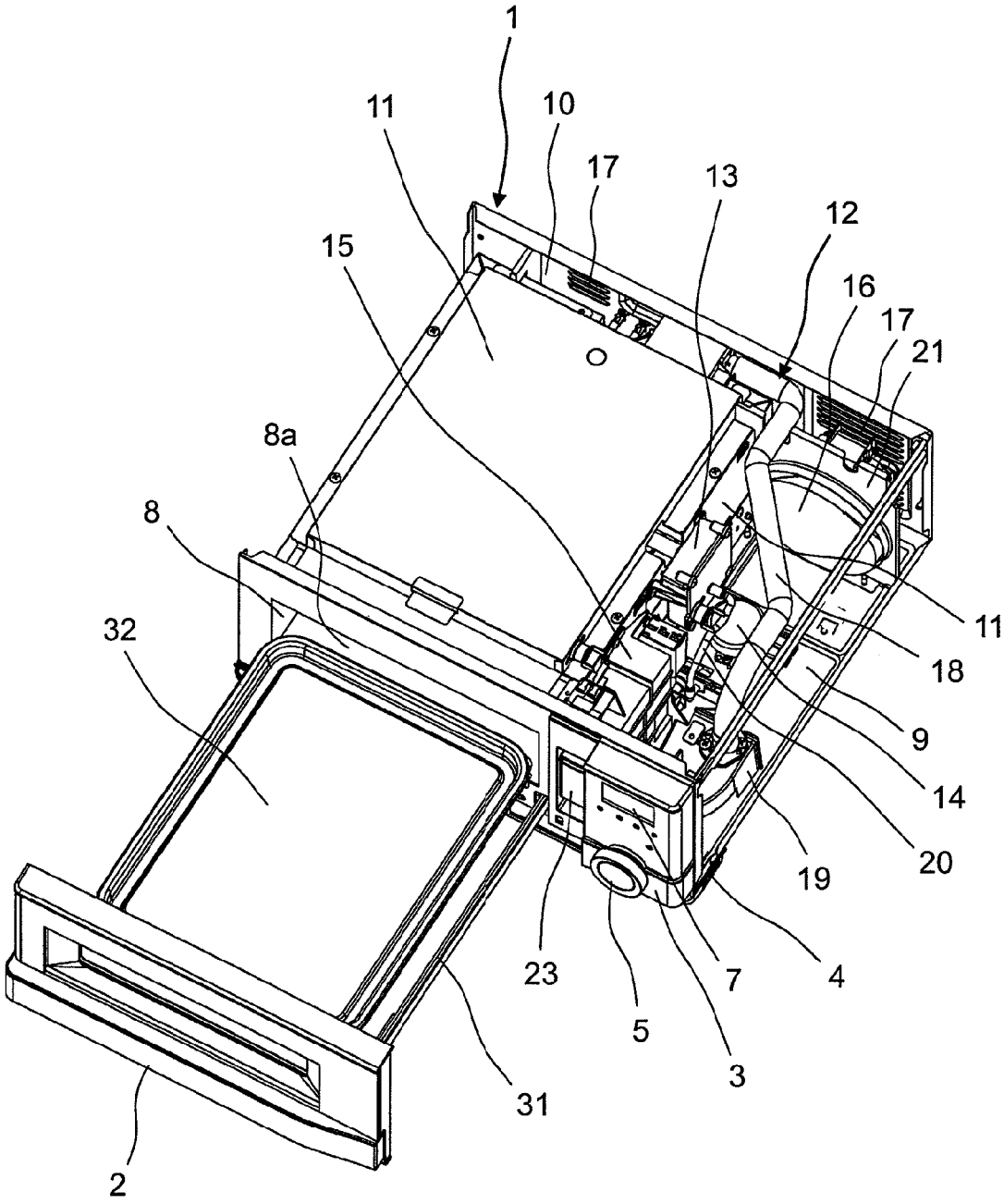
FIG. 2B is a perspective view of the cooking device having a door with handle opened.
Figure 3:
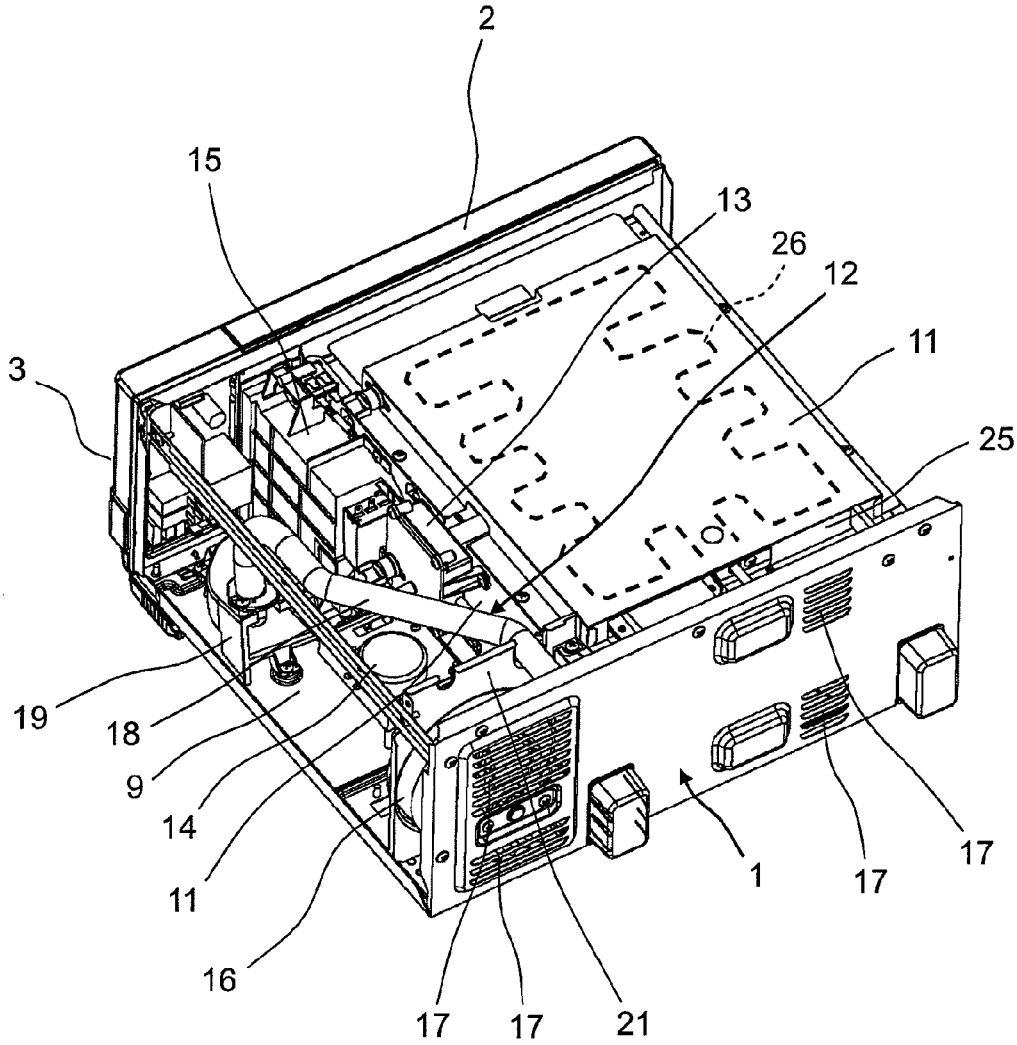
FIG. 3 is a perspective view of the cooking device as seen looking from rear and diagonal upper side thereof.

FIG. 2A shows a perspective view of the cooking device, from which a top part and both side parts of the casing 1 are removed, as seen looking from front and diagonal upper side, and FIG. 2B shows a perspective view of the cooking device having the door 2 with handle opened. FIG. 3 is a perspective view of the cooking device of FIG. 2A as seen looking from rear and diagonal upper side. In FIGS. 2A, 2B and 3, the same components are provided with the same reference numerals.

As shown in FIGS. 2A, 2B and 3, the heating chamber 8 for heating an object to be cooked is provided in the casing 1 (see FIG. 2B). In the casing 1, an electric component chamber 9 as an example of a cooling space is provided on a lateral side of the heating chamber 8 and on rear side of the operation panel 3, and an air intake space 10 is provided on rear side of the heating chamber 8 and on rear side of the electric component chamber 9.

The heating chamber 8 has the opening 8*a* (shown in FIG. 2B) on the front face side, and the door 2 with handle opens and closes the opening 8*a* by being slid forward and rearward by a pair of rail units 31. The rail units 31 each have a movable rail that has one end fixed to the door 2 with handle and a fixed rail that is fixed to the casing 1 and that slidably supports the movable rail. A tray 32 is drawn out with the door 2 with handle. By opening and closing of the door 2 with handle, an object to be cooked that is placed on the tray 32 is taken out of and put into the heating chamber 8. Heat shield plates 11, 11, . . . are provided on top, bottom, rear side, and both lateral sides of the heating chamber 8. That is, the heat shield plates 11, 11, . . . are provided around the heating chamber 8 except on the opening 8*a*. Spaces between the heat shield plates 11 and the heating chamber 8 are filled with heat insulating material (not shown).

In the electric component chamber 9 are a steam producing device 13 for producing steam that is supplied into the heating chamber 8, a water supply pump 14 connected to the steam producing device 13 through a water supply tube 20, and a tank housing part 15 placed in front of the water supply pump 14. When the object to be cooked is heated, cooling air from a cooling fan 16 flows through the electric component chamber 9 so that electric components such as the water supply pump 14 can be cooled.

With drive of the cooling fan 16, air outside the casing 1 flows through four air intakes 17, 17, 17, 17 into the air intake space 10. The air in the air intake space 10 is delivered into the electric component chamber 9 by the cooling fan 16. The air intakes 17 are each composed of a plurality of slits provided on rear part of the casing 1.

An upstream end of the exhaust tube 18 as an example of an exhaust path is connected to an exhaust opening, provided on the rear part of the heating chamber 8, through a catalyst unit (not shown) provided above the rear part of the heating chamber 8. A downstream end (exhaust exit) of the exhaust tube 18 is connected to an exhaust duct 19 that is provided on a lateral side of the tank housing part 15 and that is made of synthetic resin. The exhaust tube 18 is composed of synthetic resin having flexibility and is provided so as to extend from upper part of the rear face side to lower part of the front face side of the electric component chamber 9.

Gas in the heating chamber 8 is discharged out of the casing 1 by being guided from the rear part to the front face side of the casing 1 by the exhaust tube 18 and the exhaust duct 19.

In FIGS. 2A, 2B and 3, reference numeral 21 denotes a partition wall that serves as a partition between the electric component chamber 9 and the air intake space 10. The cooling fan 16 is mounted on the partition wall 21. As shown in FIG. 3, an upper heater housing part 25 is provided on upper side in the heating chamber 8, and an upper heater 26 is provided in the upper heater housing part 25. A steam temperature increasing device is composed of the upper heater housing part 25 and the upper heater 26. A lower heater housing part (not shown) is provided on lower side in the heating chamber 8, and a lower heater (not shown) is provided in the lower heater housing part.

Figure 4:
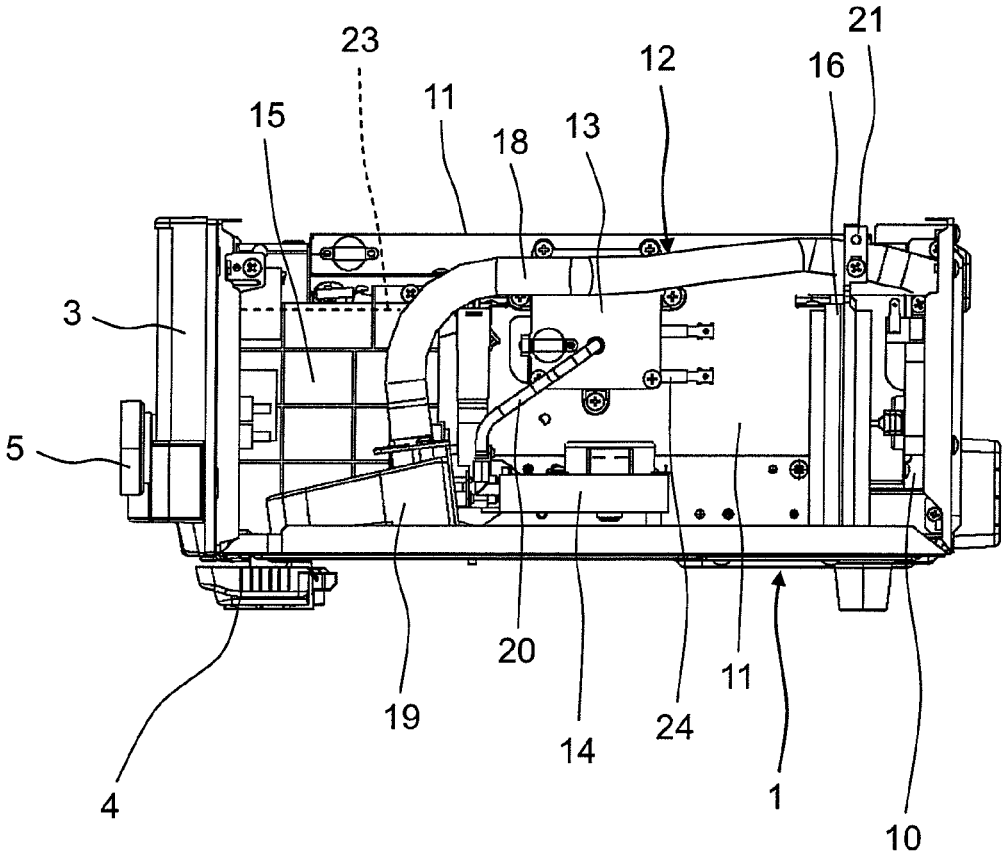
FIG. 4 is a perspective view of the cooking device as seen looking from a lateral side thereof.

FIG. 4 is a perspective view of the cooking device of FIG. 2A as seen looking from a lateral side thereof.

The tank housing part 15 houses a water supply tank 23. Once the door 2 with handle is opened, a front face of the water supply tank 23 is exposed so that the water supply tank 23 can be drawn out of and inserted into the tank housing part 15 (see FIG. 2B). Water in the water supply tank 23 is supplied through the water supply tube 20 into the steam producing device 13 by drive of the water supply pump 14. The steam producing device 13 heats the water from the water supply pump 14 by a steam producing heater 24 and thereby produces steam.

Figure 5:
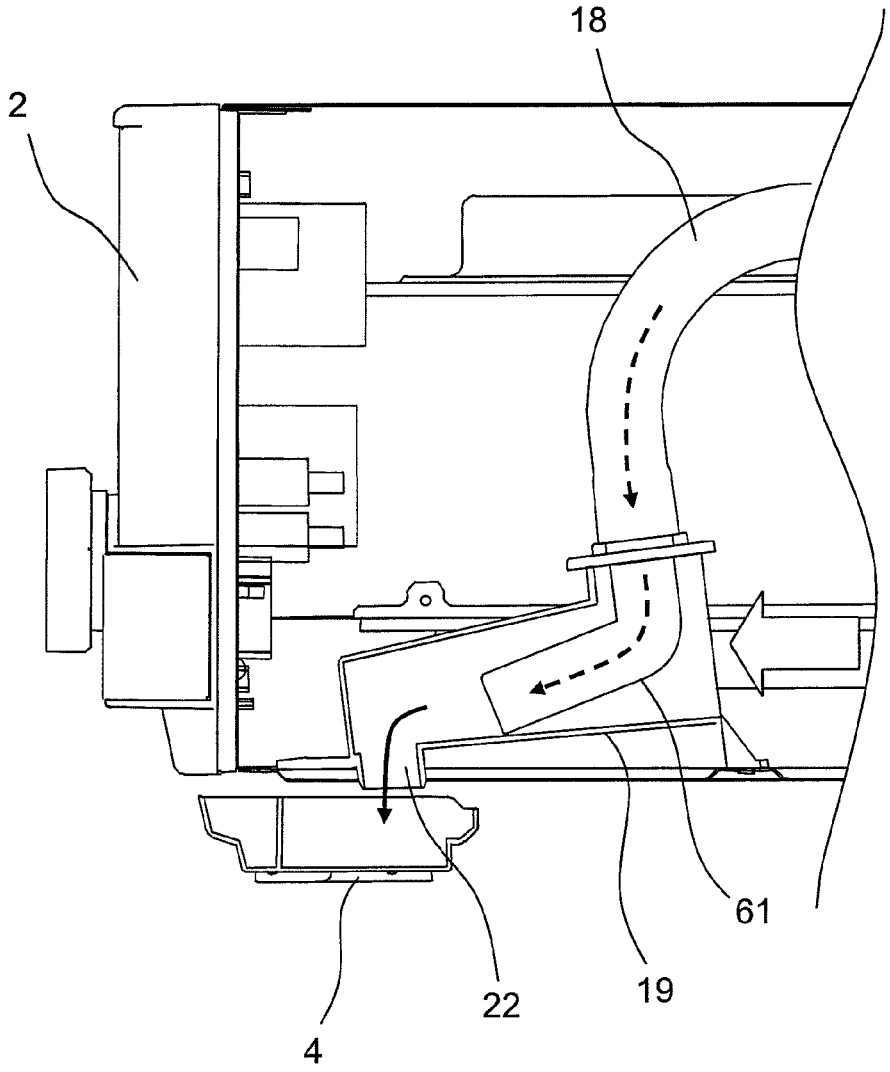
FIG. 5 is a schematic representation of an enlarged section of an important part of the cooking device, as seen looking from the lateral side thereof.

FIG. 5 shows a schematic representation of an enlarged section of an important part of the cooking device, as seen looking from the lateral side thereof. As shown in FIG. 5, a discharge port 22 is provided on front bottom part of the exhaust duct 19. The discharge port 22 extends through the bottom part of the casing 1 and faces the dew receiving container 4. A nozzle part 61 to which the downstream end (exhaust exit) of the exhaust tube 18 is connected is inserted into the exhaust duct 19, and an opening 61*a* on an extremity of the nozzle part 61 is directed toward the discharge port 22.

Figure 6A:
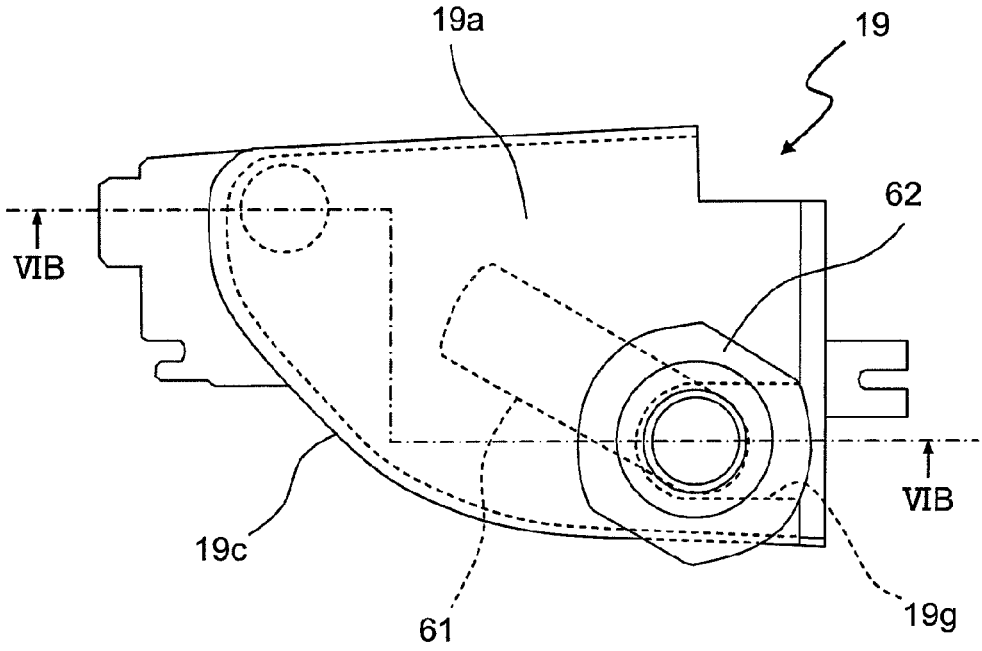
FIG. 6A is a top plan view of an exhaust duct.
Figure 6B:
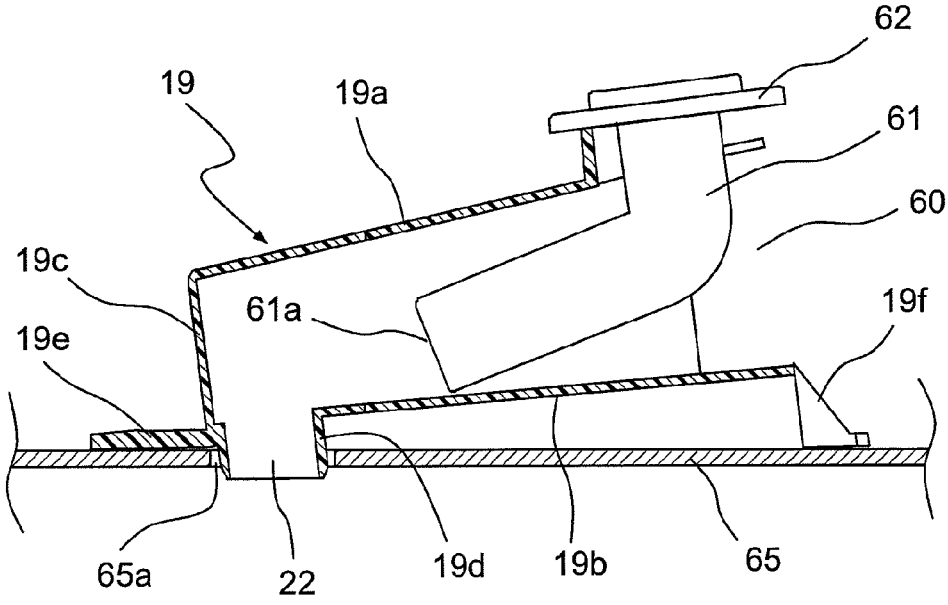
FIG. 6B is a sectional view taken along a line VIB-VIB of FIG. 6A.

FIG. 6A shows a top face of the exhaust duct 19, and FIG. 6B shows a sectional view of the exhaust duct 19 taken along a line VIB-VIB of FIG. 6A.

As shown in FIGS. 6A and 6B, the exhaust duct 19 is shaped so as to taper from a blow-in opening 60 toward the discharge port 22 and has a top wall 19*a*, a bottom wall 19*b*, a side wall 19*c* that is provided so as to enclose a space between an outer edge of the top wall 19*a* and an outer edge of the bottom wall 19*b* except the blow-in opening 60, a cylinder part 19*d* that protrudes downward from outer circumference of the discharge port 22, a first fixed part 19*e* that is provided so as to protrude frontward from vicinity of the cylinder part 19*d*, and a second fixed part 19*f* that is provided in vicinity of a lower edge of the blow-in opening 60 of the bottom wall 19*b*. In the exhaust duct 19, a cutout 19*g* is formed on a top edge of the blow-in opening 60 on the top wall 19*a*.

The nozzle part 61 generally shaped like a letter L is attached into the cutout 19*g* on the exhaust duct 19, from a side of the blow-in opening 60. The nozzle part 61 is fixed to the top wall 19*a* of the exhaust duct 19 with use of a mounting flange 62 fixed to an upper end of the nozzle part 61. The downstream end of the exhaust tube 18 is connected to the upper end of the nozzle part 61.

The cylinder part 19*d* of the exhaust duct 19 is inserted into a hole 65*a* provided on a bottom plate 65, and the exhaust duct 19 is fixed to the bottom plate 65 by screws (not shown) with use of the first fixed part 19*e* and the second fixed part 19*f*. In this state, an upper surface of the bottom wall 19*b* of the exhaust duct 19 is inclined with respect to a plane of the bottom plate 65 so that front side thereof is lowered. In the first embodiment, an angle between the upper surface of the bottom wall 19*b* of the exhaust duct 19 and the plane of the bottom plate 65 is set between 2 and 3 degrees. Thus water in the exhaust duct 19 flows toward the discharge port 22 and falls therefrom without flowing out from the blow-in opening 60.

The exhaust duct 19 is shaped so as to taper off from the blow-in opening 60 on upstream side thereof toward the discharge port 22 on downstream side thereof. The tapered shape smoothes air flow in the exhaust duct 19 and causes exhaust from the opening 61*a* on the extremity of the nozzle part 61 to be drawn and guided toward the discharge port 22.

Figure 7:
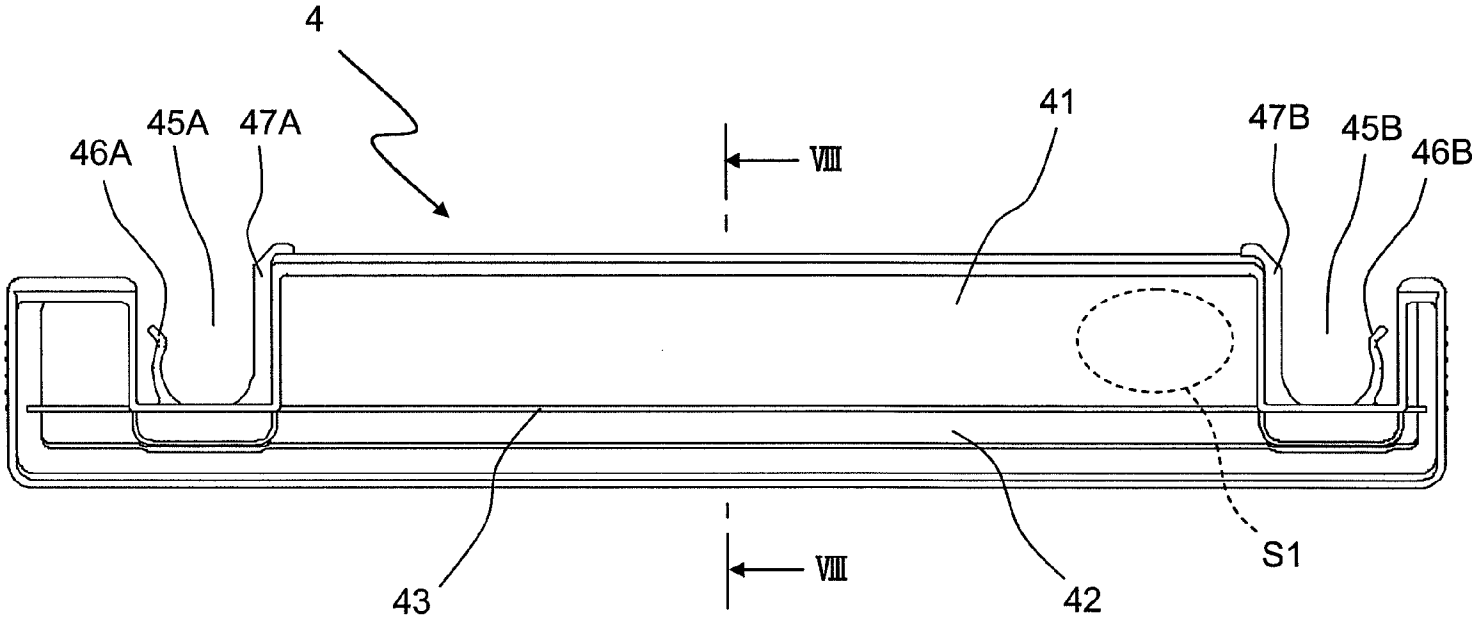
FIG. 7 is a plan view of a dew receiving container.
Figure 8:
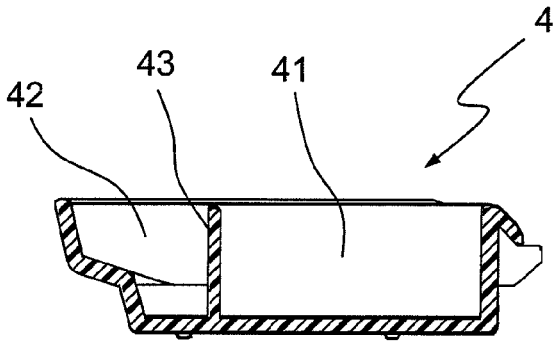
FIG. 8 is a sectional view taken along a line VIII-VIII of FIG. 7.

FIG. 7 shows a plan view of the dew receiving container 4, and FIG. 8 shows a sectional view taken along a line VIII-VIII of FIG. 7. As shown in FIGS. 7 and 8, the dew receiving container 4 has a first dew receiving recess 41 in shape of a laterally long rectangle and a second dew receiving recess 42 provided in front of the first dew receiving recess 41 with a rib 43 therebetween. Fitting recesses 45A, 45B that open on rear face side (upper side in FIG. 7) thereof are provided at both ends of the first dew receiving recess 41, and curved arm parts 46A, 46B that extend toward the rear face side are provided in the fitting recesses 45A, 45B, respectively. Guide parts 47A, 47B are provided on sides facing the first dew receiving recess 41 in the fitting recesses 45A, 45B, respectively.

When the dew receiving container 4 is attached to the two front legs 6, 6 (shown in FIG. 1) provided on the front side on the bottom part of the casing 1, fitting protruding parts (not shown) of the front legs 6, 6 are fitted into the fitting recesses 45A, 45B while being guided by the guide parts 47A, 47B of the dew receiving container 4. Then the curved arm parts 46A, 46B of the dew receiving container 4 undergo elastic deformation and thereby cooperate with the guide parts 47A, 47B to nip the fitting protruding parts (not shown) of the front legs 6, 6, so that the dew receiving container 4 is held by the front legs 6, 6.

A region S1 on right side on a bottom surface of the first dew receiving recess 41 in the dew receiving container 4 faces an opening of the discharge port 22 of the exhaust duct 19 that resides thereover. Exhaust from the discharge port 22 of the exhaust duct 19 is received by the region S1 in the first dew receiving recess 41 in the dew receiving container 4 that resides thereunder and is diffused to outside of the casing 1. Then the exhaust diffuses from inside of the first dew receiving recess 41 in the dew receiving container 4 through a gap between the dew receiving container 4 and the door 2 with handle, a gap between the dew receiving container 4 and the casing 1 and/or the like into a vast outside space on the front face side of the casing 1.

Waterdrops dropping from the discharge port 22 of the exhaust duct 19 are received by the first dew receiving recess 41 in the dew receiving container 4, and waterdrops dropping along the rear face of the door 2 with handle and the front face of the casing 1 are received by the first dew receiving recess 41 and the second dew receiving recess 42 in the dew receiving container 4.

In the cooking device having the above configuration, the water supply tank 23 containing a required quantity of water is housed in the tank housing part 15 with the door 2 with handle drawn out as shown in FIG. 2B, and heat cooking with use of steam is thereafter started by an operation on the operation panel 3. Then the upper heater 26 and the lower heater that are provided on the upper and lower sides of the heating chamber 8 are turned on, the water supply pump 14 is activated so as to supply water in the water supply tank 23 into the steam producing device 13, and steam is produced by heating of the water supplied into the steam producing device 13 by the steam producing heater 24. The steam produced by the steam producing device 13 blows out into the upper heater housing part 25 on the upper side in the heating chamber 8, and becomes superheated steam having a temperature not lower than 100° C. by being heated by the upper heater 26. The superheated steam is supplied into the heating chamber 8 through a plurality of holes provided on an upper cover not shown on a ceiling surface of the heating chamber 8. Thus food placed on the tray 32 in the heating chamber 8 is heated and cooked by radiant heat from the upper cover on the ceiling surface side of the heating chamber 8, radiant heat from the lower cover on bottom side thereof, and superheated steam that is blown out through the plurality of holes on the upper cover and that has the temperature not lower than 100° C. Then the superheated steam supplied to and deposited on surfaces of the food condenses on the surfaces of the food and gives the food a great quantity of latent heat of condensation and therefore heat can efficiently be transmitted to the food.

In the cooking device, oven cooking may be performed with use of only the upper heater 26 and the lower heater and without use of steam, and steam cooking or the like may be performed with use of only steam produced by the steam producing device 13 and without use of the upper heater 26 and the lower heater.

When the heating chamber 8 is increased in temperature and is filled with steam, smoke and/or the like produced from heated food in the heat cooking of the food put in the heating chamber 8, in the cooking device having the configuration, exhaust from the inside of the heating chamber 8 is guided by the exhaust tube 18 through the electric component chamber 9 that is the cooling space in the casing 1 to the front face side. By the dew receiving container 4 that is the exhaust receiving part provided on the front face side of the casing 1, the exhaust from the exhaust exit of the exhaust tube 18 is received and diffused to the outside of the casing 1. Therefore, highly heated exhaust containing steam from the inside of the heating chamber 8 is cooled when passing through the electric component chamber 9 in the casing 1 by way of the exhaust tube 18, so that the cooled exhaust having a decreased temperature can be received by the dew receiving container 4 on the front face side and can be diffused to the vast outside space in front of the casing 1.

On condition that there are wall surfaces in vicinity of the rear face side of a cooking device body, shelves just thereover, and/or the like, corrosion, dense growth of mold and/or the like are thereby prevented that might be caused on the wall surfaces, shelves and/or the like by contact therewith of the highly heated exhaust containing steam, because the exhaust from the heating chamber is not discharged from the rear face side of the body. Even under condition of the placement in a narrow space, accordingly, the exhaust from the inside of the heating chamber 8 can be disposed without being discharged from the rear face side.

Steam contained in the exhaust from the heating chamber condenses in the exhaust tube 18, the nozzle part 61, and the exhaust duct 19 before the discharge to the front face side of the casing 1, and thus the dehumidified exhaust can be discharged into the outside space. The condensate water produced in the exhaust tube 18, the nozzle part 61, and the exhaust duct 19 can be collected by the dew receiving container 4. The cooking device saves trouble of discarding water in the dew receiving container 4 because the condensate water collected in the dew receiving container 4 is small in quantity and is dried naturally. Direct blow of the exhaust onto a user is prevented and comfortableness is improved because the exhaust from the inside of the heating chamber 8 is once received by the dew receiving recess 41 and is then diffused to the outside of the casing 1.

Though the cooking device that performs cooking with use of superheated steam having a temperature not lower than 100° C. has been described for the first embodiment, cooking including cooking with use of only the heaters or steam cooking with use of steam or the like may be performed as cooking in which an object to be heated is heated in the heating chamber 8.

The exhaust from the inside of the heating chamber 8 is guided by the exhaust tube 18 from the rear part to the front face side of the heating chamber 8, and thus a path length of the exhaust tube 18 can be increased, so that cooling efficiency can be increased by the extension of the path running through the electric component chamber 9. Thus the temperature of the exhaust diffused to the outside of the casing 1 by the dew receiving container 4 can further be decreased.

Figure 9:
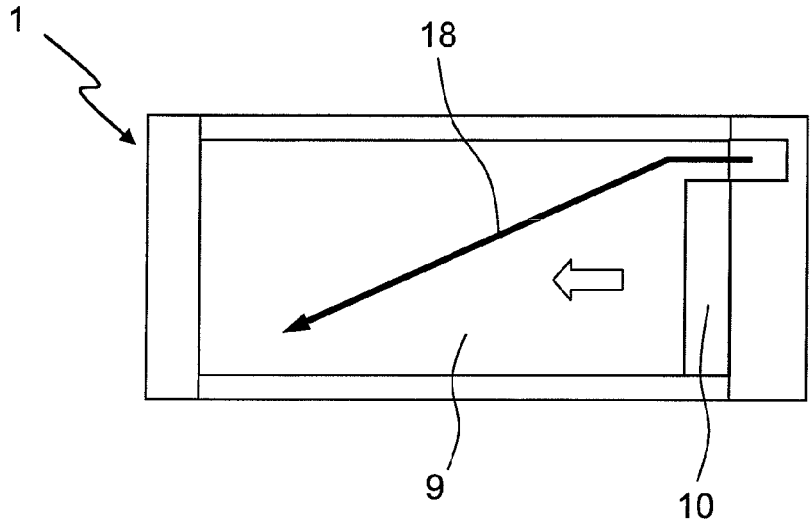
FIG. 9 is a schematic representation of the cooking device as seen looking from the lateral side thereof.

By inclination of the exhaust tube 18 from the rear part toward the front face side of the heating chamber 8 and from upper side of the rear part toward lower side of the front face side of the heating chamber 8, as shown in FIG. 9, the path running through the electric component chamber 9 that is the cooling space can be extended so that the cooling efficiency can be improved, and condensate water that may be produced by cooling of highly heated exhaust containing steam in the electric component chamber 9 is made to flow down through the exhaust tube 18 toward the downstream side. This prevents stagnation of the condensate water in the exhaust tube 18, impediment against flow of the exhaust, and unsanitary condition in the exhaust tube 18.

Figure 10:
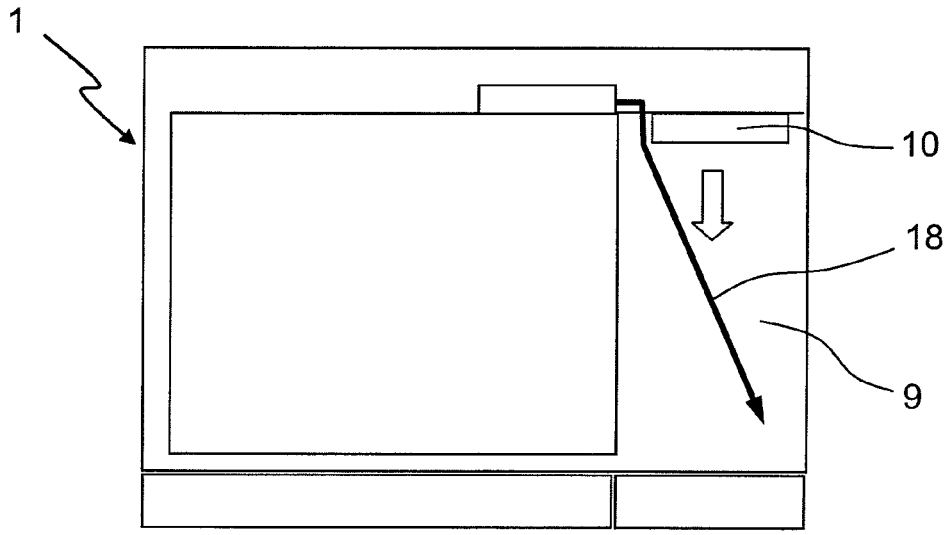
FIG. 10 is a schematic representation of the cooking device as seen looking from above.

As shown in FIG. 10, the exhaust tube 18 guides the exhaust from vicinity of the rear part of the heating chamber 8 toward the front face side and the outside, in the electric component chamber 9 that is the cooling space provided from the lateral side and the rear face side of the heating chamber 8 to the front face side in the casing 1, and thus the path length of the exhaust tube 18 can be increased, so that the cooling efficiency can be increased by the extension of the path running through the electric component chamber 9, and so that the temperature of the exhaust diffused to the outside of the casing 1 by the dew receiving container 4 that is the exhaust receiving part can further be decreased.

A portion of cooling air from the cooling fan 16 for cooling the electric components is blown into the blow-in opening 60 provided on the upstream side in the exhaust duct 19 provided in the casing 1 and on the front face side in the electric component chamber 9 that is the cooling space. The cooling air blown in through the blow-in opening 60 of the exhaust duct 19 is guided by the top wall 19*a*, the bottom wall 19*b*, and the side wall 19*c* of the exhaust duct 19 and is discharged through the discharge port 22 provided on the downstream side. Then the exhaust flows into the exhaust duct 19 through the opening 61*a* of the nozzle part 61 provided in an air path between the blow-in opening 60 and the discharge port 22 in the exhaust duct 19 and is mixed with the cooling air, so that the exhaust diluted by mixing with the cooling air is discharged through the discharge port 22 of the exhaust duct 19. With such utilization of the cooling air from the cooling fan 16 for cooling the electric components, the temperature of the exhaust can be decreased by the dilution of the exhaust, and the exhaust from the inside of the heating chamber 8 can efficiently be discharged by smoothing of flow of the exhaust by way of the exhaust duct 19.

The dew receiving container 4, having both a function of receiving dew and a function of receiving and diffusing exhaust, makes it possible to simplify a structure of the device and to reduce manufacturing cost, cost of components and the like therefor.

Figure 11:
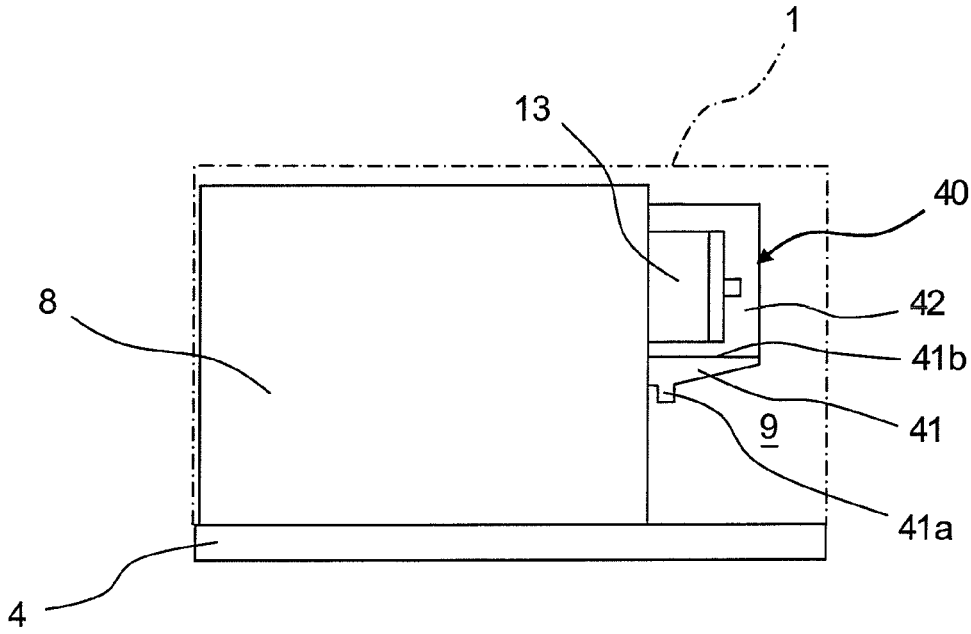
FIG. 11 is a schematic representation of a cooking device in accordance with another embodiment, as seen looking from front side thereof.
Figure 12:
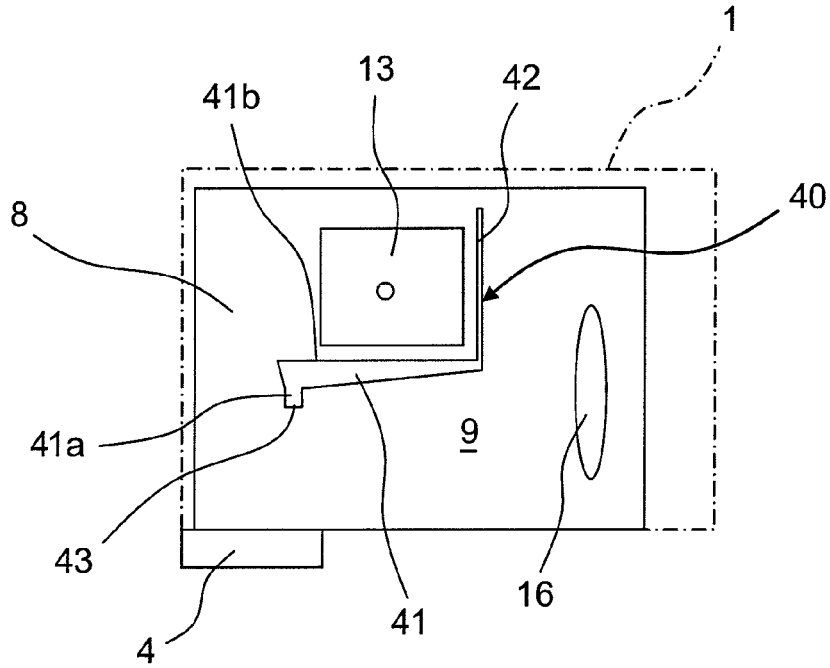
FIG. 12 is a schematic representation of the cooking device, as seen looking from a lateral side thereof.

FIG. 11 shows a schematic representation of a cooking device in accordance with another embodiment, as seen looking from front side thereof, and FIG. 12 shows a schematic representation of the cooking device, as seen looking from a lateral side thereof. The cooking device of the embodiment has the same configuration as the cooking device shown in FIGS. 1 through 8 has, except for shield plates.

In the electric component chamber 9 in which the steam producing device 13 is placed at right of the heating chamber 8, as shown in FIGS. 11 and 12, a shield member 40 is mounted so as to cover underside and rear face side (right direction in FIG. 12) of the steam producing device 13. The shield member 40 includes a bottom part 41 having a cylinder part 41*a* protruding downward on front face side (left direction in FIG. 12) thereof and a side wall part 42 extending upward from rear edge side of the bottom part 41. The bottom part 41 has a recessed part 41*b* formed of a sloped surface sloping down toward the cylinder part 41*a* on the front face side. A drain opening 43 on the cylinder part 41*a* on lower side of the shield member 40 is connected to a drain path (not shown).

By provision around the steam producing device 13 of the shield member 40 that blocks off cooling air from the cooling fan 16, the steam producing device 13 can be prevented from being cooled by the cooling air and thus efficiency of evaporation can be improved by reduction in heat loss in the steam producing device 13. In event that water leak from the steam producing device 13 occurs, leaking water is guided through the recessed part 41*b* and the cylinder part 41*a* into the drain path by the bottom part 41 of the shield member 40 that covers the underside of the steam producing device 13. Thus the leaking water can be prevented from dropping onto other electric components and the like and leaking out of the body, in the event of water leak that may be caused by faulty sealing between a heat source cast part and a cover part, cracks in water supply parts and/or the like in the steam producing device 13.

Though the shield member 40 covers the underside and the rear face side of the steam producing device 13 without covering front face side, top side or lateral sides thereof, the cooling air scarcely goes around from those directions. There may be used, however, the shield member that further covers at least either of the front face side, the top side and the lateral sides of the steam producing device 13.

The cooking device using the dew receiving container 4 that diffuses exhaust from the exhaust exit of the exhaust path has been described for the first embodiment, whereas a form of the dew receiving container is not limited thereto and the dew receiving container has only to receive exhaust from the exhaust exit of the exhaust path and to diffuse the exhaust to the outside of the casing.

The cooking device that discharges the exhaust from the inside of the heating chamber 8 through the exhaust tube 18 and the exhaust duct 19 that are the exhaust path into the dew receiving container 4 has been described for the first embodiment, whereas the exhaust from the inside of the heating chamber may be discharged through an exhaust path into the dew receiving container without use of the exhaust duct.

Though the opening 8*a* of the heating chamber 8 is opened and closed by the door 2 with handle that slides in the frontward and rearward directions with respect to the casing 1 in the first embodiment, whereas the opening of the heating chamber may be opened and closed by a door of pivoting type, for instance. That is, the door the cooking device of the invention includes may be of slide type or pivoting type.

Second Embodiment

Figure 13:
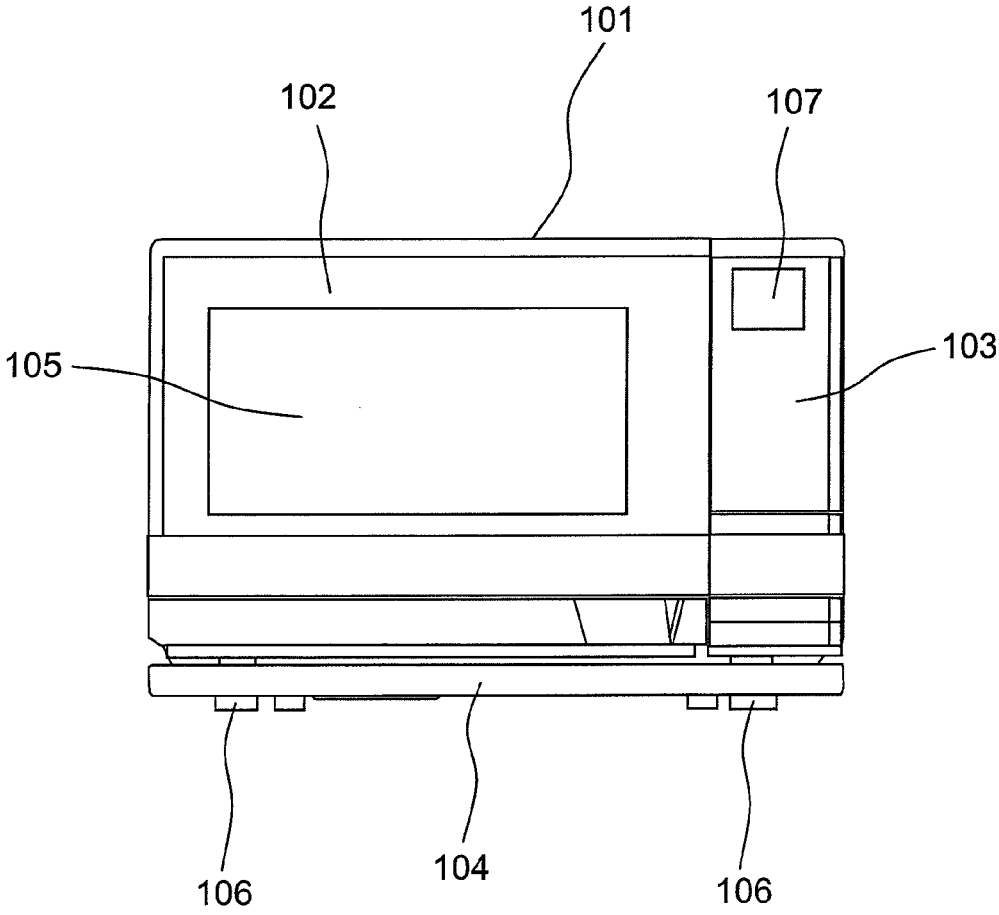
FIG. 13 is a front view of a cooking device in accordance with a second embodiment of the invention.

FIG. 13 is a front view of a cooking device in accordance with a second embodiment of the invention.

As shown in FIG. 13, the cooking device has a casing 101, and a door 102 with handle, as an example of the door, that is mounted on front face side of the casing 101. Heat resistant glass 105 is mounted at general center of the door 102 with handle. An operation panel 103 is provided on the front face side of the casing 101 so as to adjoin the door 102 with handle that is closed. A dew receiving container 104 as an example of the exhaust receiving part is provided under the door 102 with handle and the operation panel 103.

A plurality of push buttons and the like are mounted on the operation panel 103. The operation panel 103 has a liquid crystal display part 107, and the liquid crystal display part 107 provides displays according to operations.

The dew receiving container 104 is a container that is attachable to and detachable from two front legs 106, 106 provided on front side on bottom part of the casing 101. Once the dew receiving container 104 is inserted to underside of the casing 101 from front side toward rear side and is mounted on the front legs 106, 106, a portion of the dew receiving container 104 is positioned under a rear face (back face) of the door 102 with handle that is closed. Thus condensate water deposited on the rear face of the door 102 with handle drops into the dew receiving container 104 placed under an opening 108*c* (shown in FIG. 19) of the heating chamber 108 (shown in FIG. 19) when the door 102 with handle is opened.

Figure 14:
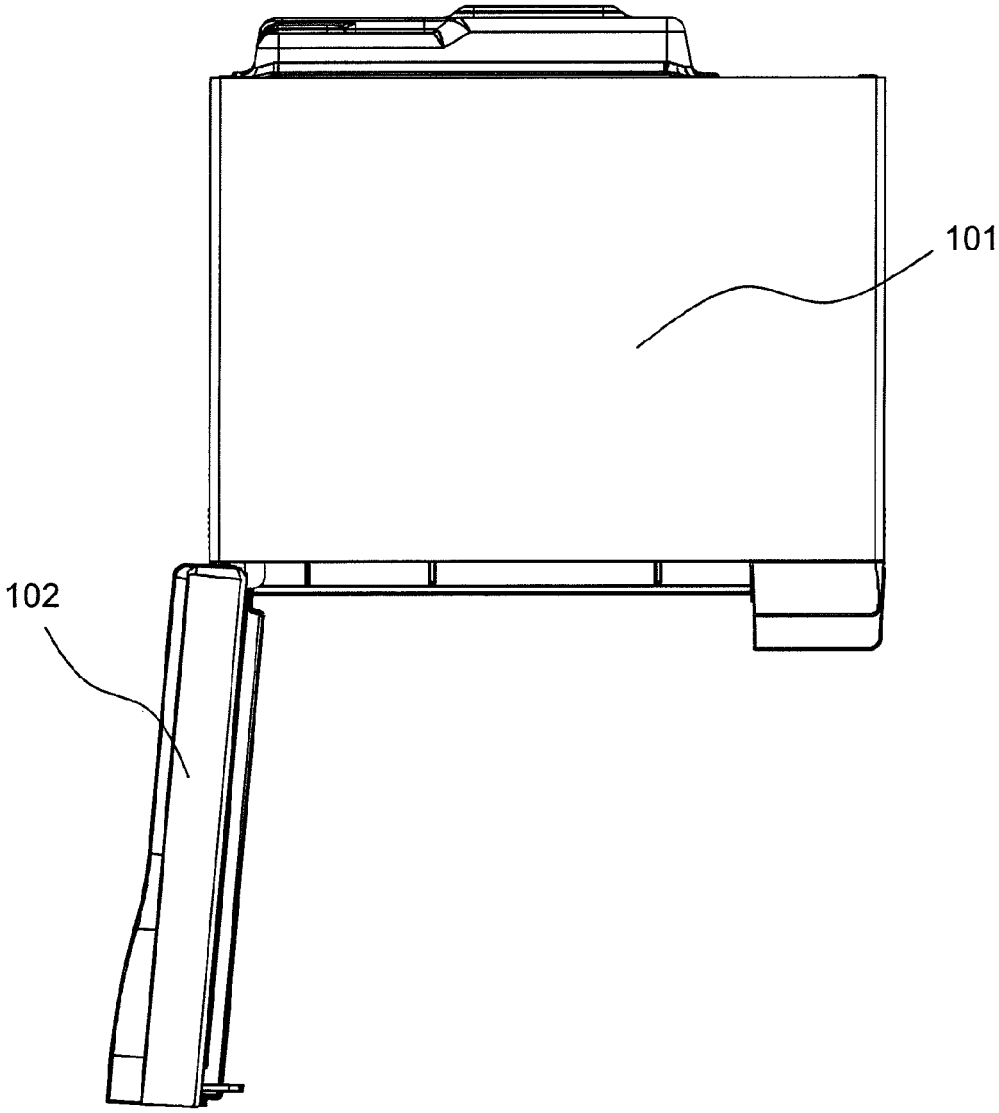
FIG. 14 is a top plan view of the cooking device.

FIG. 14 shows a top plan view of the cooking device. As shown in FIG. 14, the door 102 with handle that is provided on the front face side of the casing 101 pivots in left and right directions on left side end part of the casing 101 and opens and closes the opening 108*c* (shown in FIG. 19) on the front face of the heating chamber 108 (shown in FIG. 15).

Figure 15:
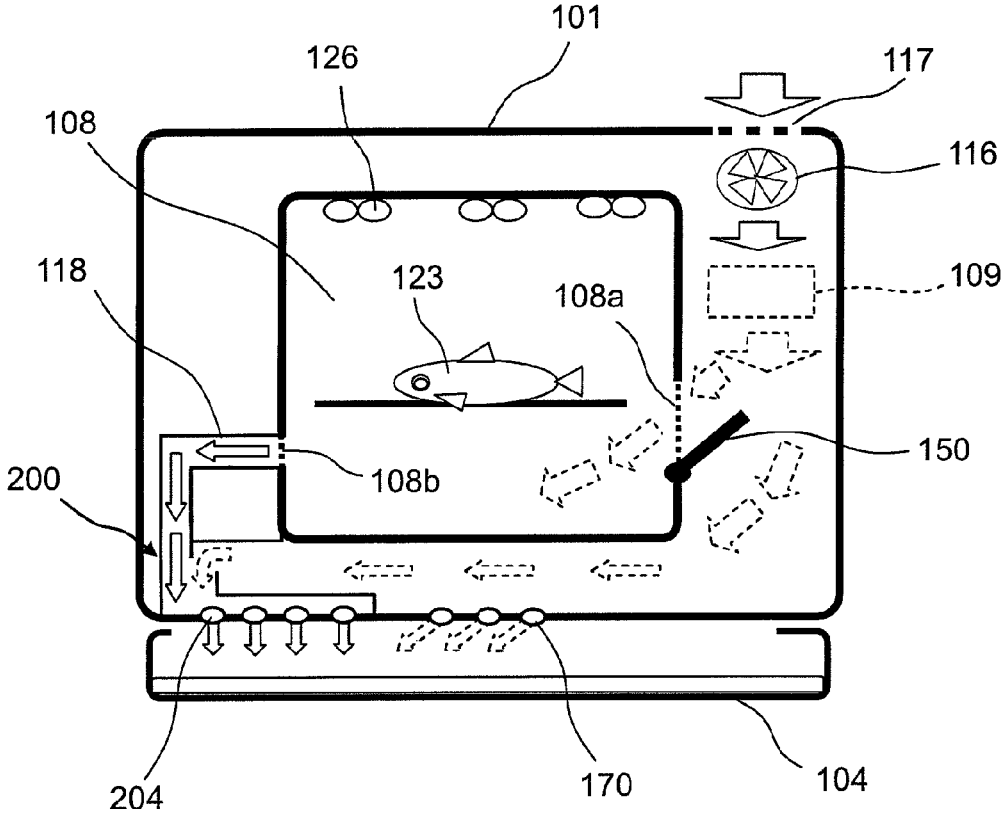
FIG. 15 is a schematic section of the cooking device.

FIG. 15 shows a schematic section of the cooking device. In the cooking device, as shown in FIG. 15, a portion of air taken in by a cooling fan 116 from outside through an air intake 117 passes through an electric component chamber 109 as an example of the cooling space and thereafter flows into the heating chamber 108 through an air supply opening 108*a* that is in open state with opening of an air supply damper 150. On the other hand, the other portion of the air taken in from the outside passes through the electric component chamber 109 and thereafter flows to bottom part side of the casing 101 and then through an air path under the heating chamber 108 into a cooling air inlet 202 (shown in FIGS. 19 and 23) of an exhaust duct 200.

A portion of air in the heating chamber 108 is discharged into the exhaust duct 200 through an exhaust opening 108*b* and an exhaust tube 118 as an example of the exhaust path and is mixed with air, having flowed from the cooling air inlet 202, in the exhaust duct 200. Then the exhaust diluted in the exhaust duct 200 is blown downward through four discharge ports 204 into the dew receiving container 104.

A portion of the air that flows to the bottom part side of the casing 101 and that then flows through the air path under the heating chamber 108 is blown through a plurality of cooling air blow-off openings 170, provided on front face side on a bottom plate 130 (shown in FIG. 20A) of the casing 101, toward a region S2 (FIG. 27) in the dew receiving container 104 that receives and diffuses the exhaust from the discharge ports 204.

Figure 16:
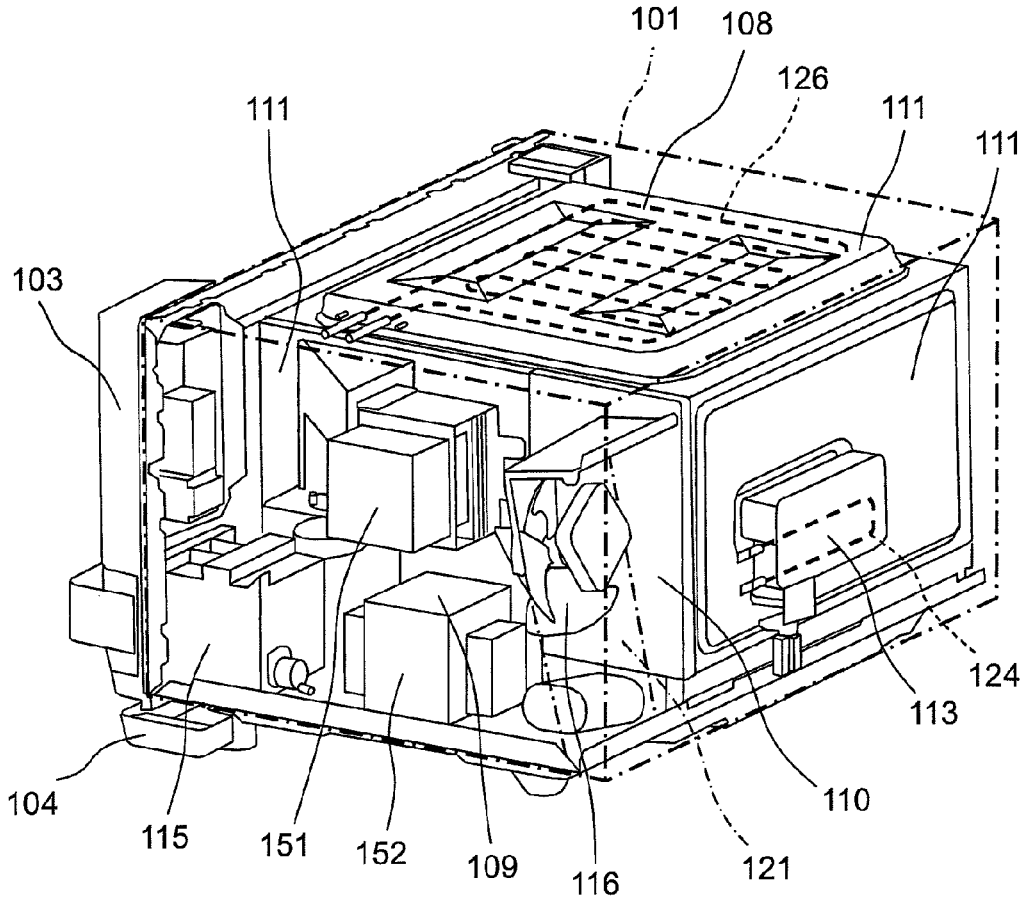
FIG. 16 is a perspective view of the cooking device from which a casing has been removed, as seen looking from rear and diagonal upper side thereof.

FIG. 16 shows a perspective view of the cooking device from which the casing 101 has been removed, as seen looking from rear and diagonal upper side.

As shown in FIG. 16, the heating chamber 108 for heating an object 123 to be heated (shown in FIG. 15) is provided in the casing 101. In the casing 101, the electric component chamber 109 as an example of the cooling space is provided on a lateral side of the heating chamber 108 and on rear side of the operation panel 103, and an air intake space 110 is provided on rear side of the heating chamber 108 and on rear side of the electric component chamber 109.

The heating chamber 108 has an opening 108*c* (shown in FIG. 19) on the front face side thereof, and the door 102 with handle opens and closes the opening 108*c* by pivoting in the left and right directions. Heat shield plates 111, 111, . . . are provided on top, bottom, rear side, and both lateral sides of the heating chamber 108. That is, the heat shield plates 111, 111, . . . are provided around the heating chamber 108 except on the opening 108*c*. Spaces between the heat shield plates 111 and the heating chamber 108 are filled with heat insulating material (not shown).

The steam producing device 113 for producing steam that is supplied into the heating chamber 108 is provided on the rear face side of the heating chamber 108, and a water supply pump (not shown) connected to the steam producing device 113 through a water supply tube is provided under the heating chamber 108. A tank housing part 115 in which a water supply tank (not shown) is housed, a magnetron 151, a power supply transformer 152 and the like are provided in the electric component chamber 109 in the casing 101. When the object 123 to be heated is heated, cooling air from the cooling fan 116 flows through the electric component chamber 109 so that electric components such as the magnetron 151 can be cooled.

With drive of the cooling fan 116, air outside the casing 101 flows through a plurality of air intakes (not shown) into the air intake space 110. The air in the air intake space 110 is delivered into the electric component chamber 109 by the cooling fan 116. The air intakes are each composed of a plurality of slits provided in rear part of the casing 101.

In FIG. 16, reference numeral 121 denotes a partition wall that serves as a partition between the electric component chamber 109 and the air intake space 110. The cooling fan 116 is mounted on the partition wall 121. A heater 126 is provided on upper side in the heating chamber 108. Microwaves produced by the magnetron 151 are guided through a waveguide (not shown) to center of lower part of the heating chamber 108, are radiated toward upside in the heating chamber 108 while being stirred by a rotating antenna (not shown), and thereby heat the object to be heated 123 (shown in FIG. 15).

Water in the water supply tank housed in the housing part 115 is supplied through the water supply tube (not shown) into the steam producing device 113 by drive of the water supply pump. The steam producing device 113 heats the water from the water supply pump by a steam producing heater 124 and thereby produces steam.

Figure 17:
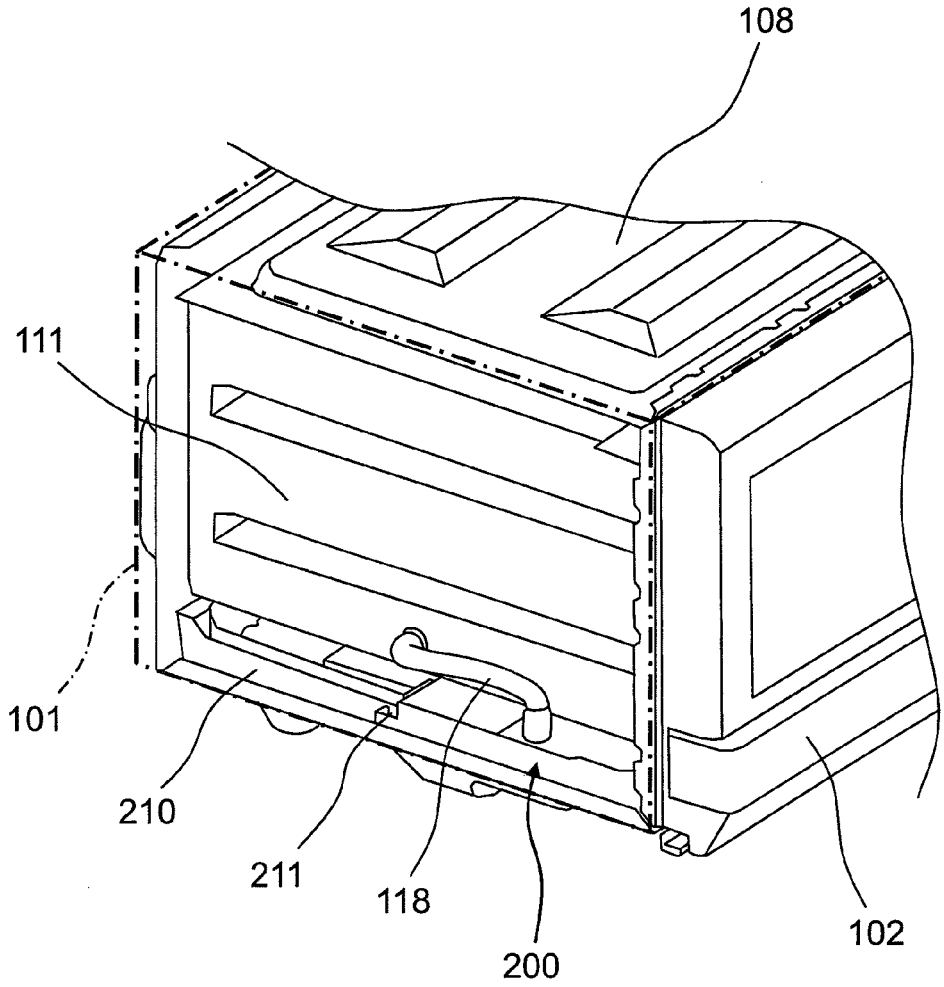
FIG. 17 is a perspective view of the cooking device from which the casing has been removed, as seen looking from front and diagonal upper side thereof.
Figure 18:
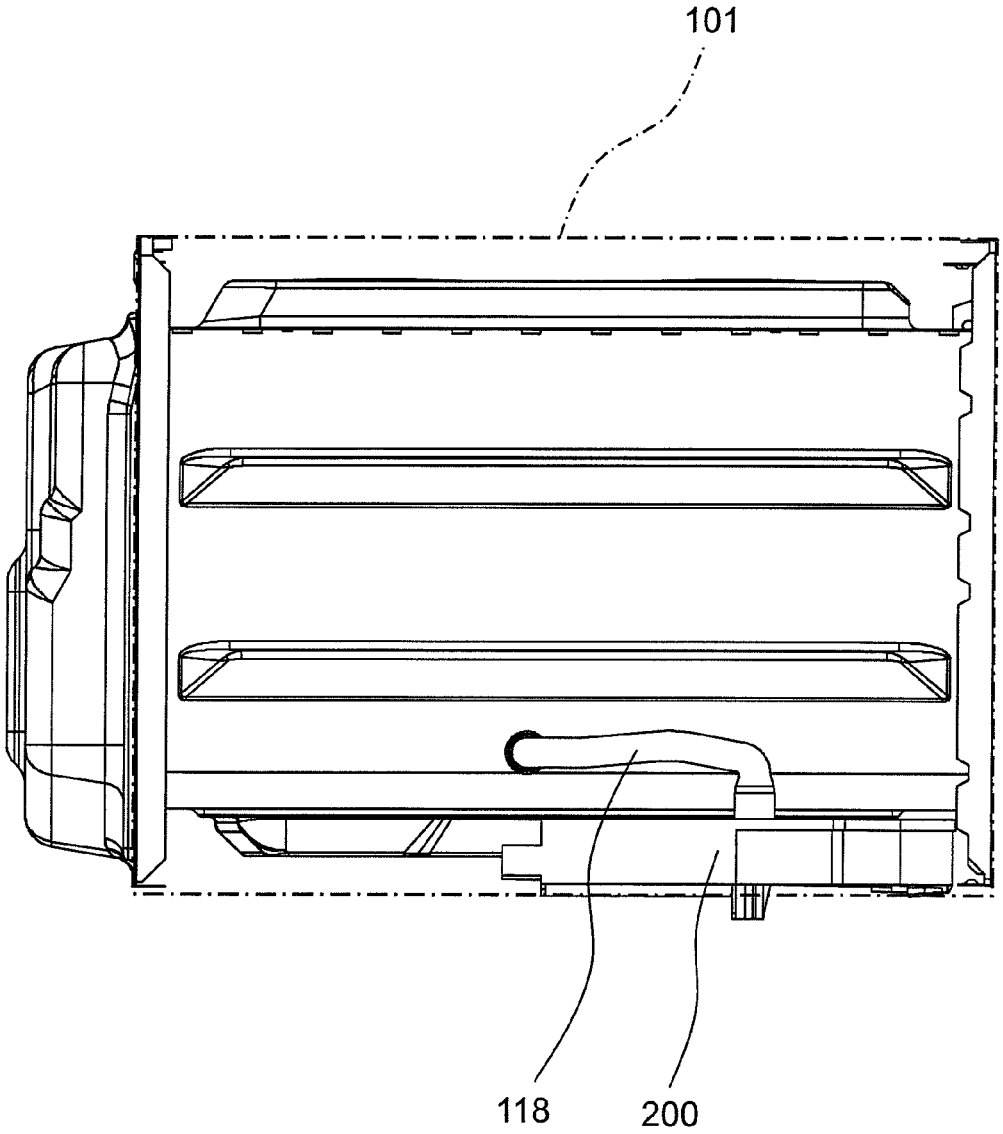
FIG. 18 is a left side view of the cooking device from which the casing has been removed.

FIG. 17 shows a perspective view of the cooking device from which the casing 101 has been removed, as seen looking from front and diagonal upper side thereof, and FIG. 18 shows a left side view of the cooking device from which the casing 101 has been removed. As shown in FIGS. 17 and 18, an upstream end of the exhaust tube 118 is connected to the exhaust opening 108*b* (shown in FIG. 15) provided on a left side wall of the heating chamber 108, and a downstream end (exhaust exit) of the exhaust tube 118 is connected to the exhaust duct 200 made of synthetic resin and provided on lower left and the front face side in the casing 101. The exhaust tube 118 is composed of synthetic resin having flexibility.

Gas in the heating chamber 108 is discharged out of the casing 101 by being guided from the side part to the front face side of the casing 101 by the exhaust tube 118 and the exhaust duct 200.

Extremity part of a drain groove 210 is connected to a drain receiving part 211 on rear face side of the exhaust duct 200. The drain groove 210 receives condensate water having dropped along side faces of the heat shield plates 111 that cover the heating chamber 108.

Figure 19:
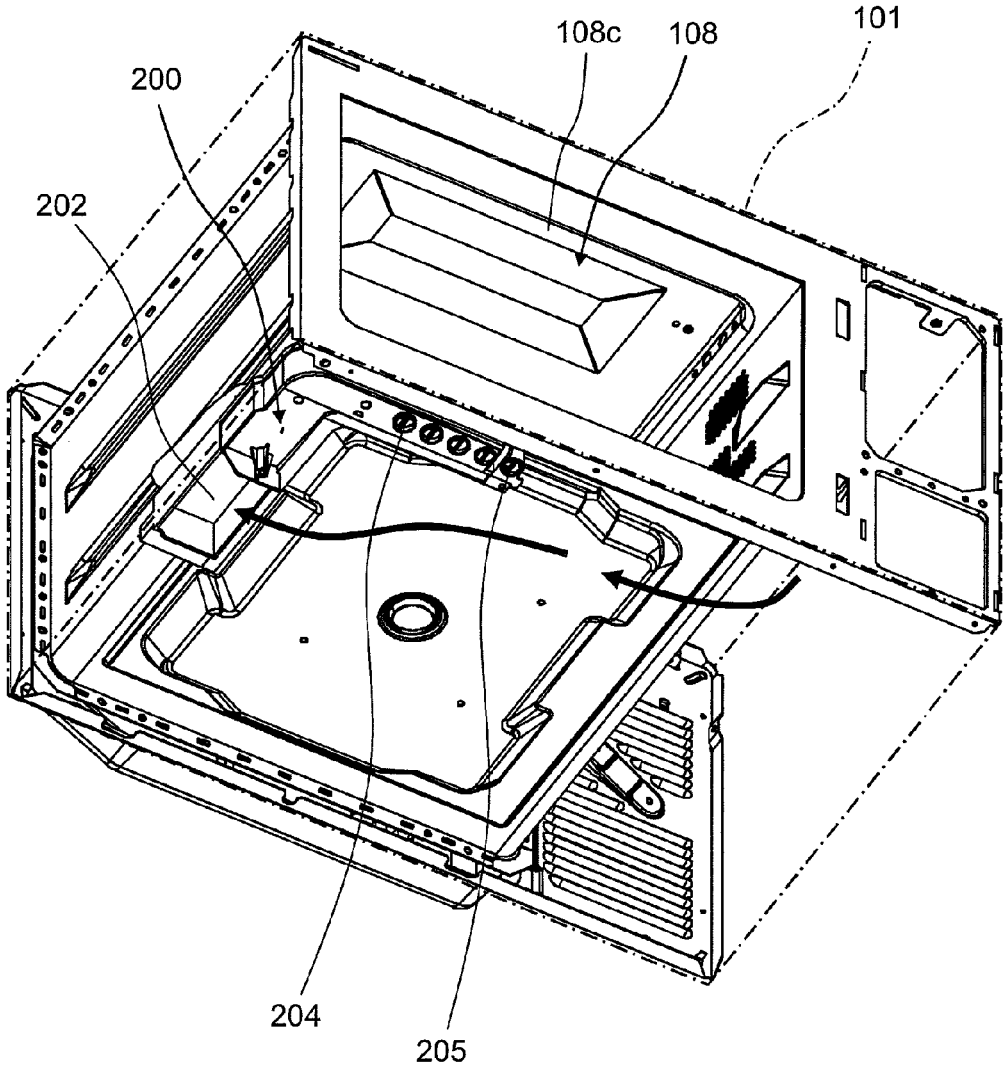
FIG. 19 is a perspective view of the cooking device from which the casing and a bottom plate have been removed, as seen looking from front and diagonal lower side thereof.

FIG. 19 shows a perspective view of the cooking device from which the casing 101 and the bottom plate 130 have been removed, as seen looking from front and diagonal lower side thereof, and the exhaust duct 200 shaped like a letter L is placed in a corner part on the front left and lower side of the casing 101. The cooling air inlet 202 is provided on the rear face side and lower side of the exhaust duct 200 so that an opening thereof faces downward, the four discharge ports 204 are provided at specified intervals along the left and right directions on front face side and lower side of the exhaust duct 200, and a drain opening 205 is provided at right of the discharge ports 204.

Figure 20A:
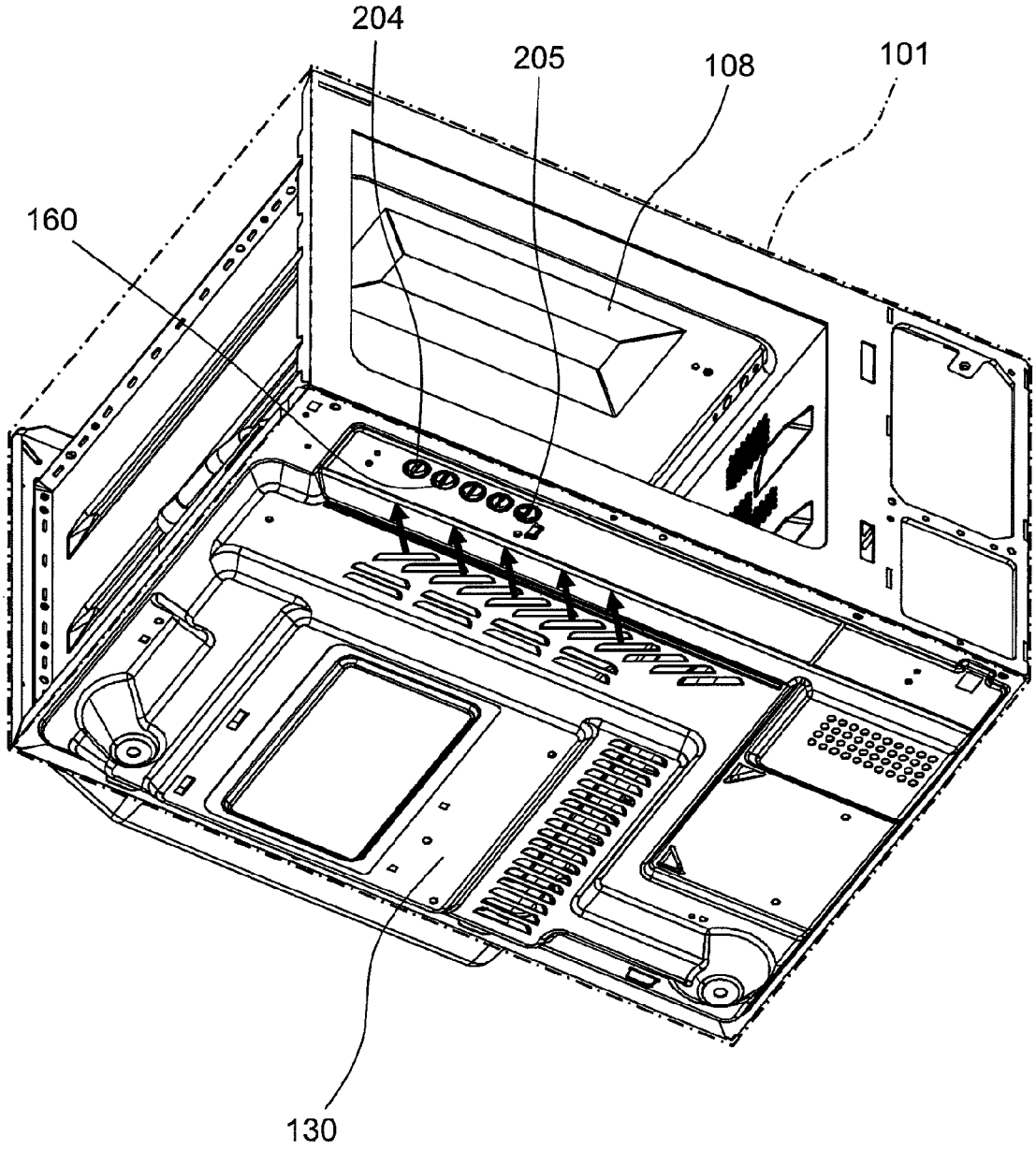
FIG. 20A is a perspective view of the cooking device which is shown in FIG. 19 and on which the bottom plate is mounted, as seen looking from the front and diagonal lower side.

FIG. 20A shows a perspective view of the cooking device which is shown in FIG. 19 and on which the bottom plate 130 is mounted, as seen looking from the front and diagonal lower side. As shown in FIG. 20A, five circular holes 160 corresponding to the four discharge ports 204 and the drain opening 205 on the front face side and lower side of the exhaust duct 200 (shown in FIG. 19) are provided on the front face side on the bottom plate 130 of the casing 101.

On the front face side on the bottom plate 130 of the casing 101 and on the rear face side of the circular holes 160 are provided the plurality of cooling air blow-off openings 170 through which the portion of the cooling air from the cooling fan (shown in FIG. 16) is blown off toward the region S2 in the dew receiving container 104 (shown in FIGS. 21, 22, and 27) that receives and diffuses the exhaust from the discharge ports 204.

Figure 20B:
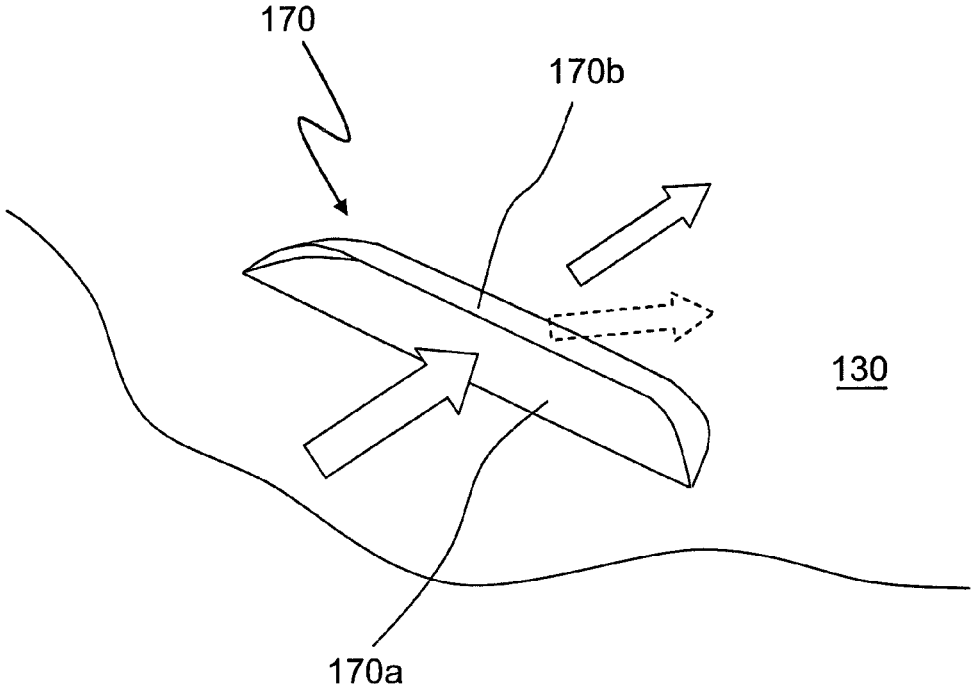
FIG. 20B is a perspective view of a cooling air blow-off opening having a slit part and a cut and raised part, as seen looking from rear and diagonal upper side thereof.

As shown in FIG. 20B, the cooling air blow-off openings 170 have a plurality of slit parts 170*a* arranged at specified intervals along the left and right direction and cut and raised parts 170*b* as an example of cooling air guiding parts that are provided on longitudinal edges on one side (downwind side for the cooling air) of the slit parts 170*a*. A longitudinal direction of the slit parts 170*a* is inclined from left rear face side toward right front face side with respect to the left and right direction along a bottom edge of the front face of the casing 101. The cut and raised parts 170*b* of the cooling air blow-off openings 170 are formed by cutting and raising of the casing 101 toward inside (upside in FIG. 20B).

The cut and raised parts 170*b* are provided as the cooling air guiding parts in the cooling air blow-off openings 170 in the second embodiment, whereas the cooling air guiding parts are not limited thereto and flow of the cooling air may be controlled by other members.

Figure 21:
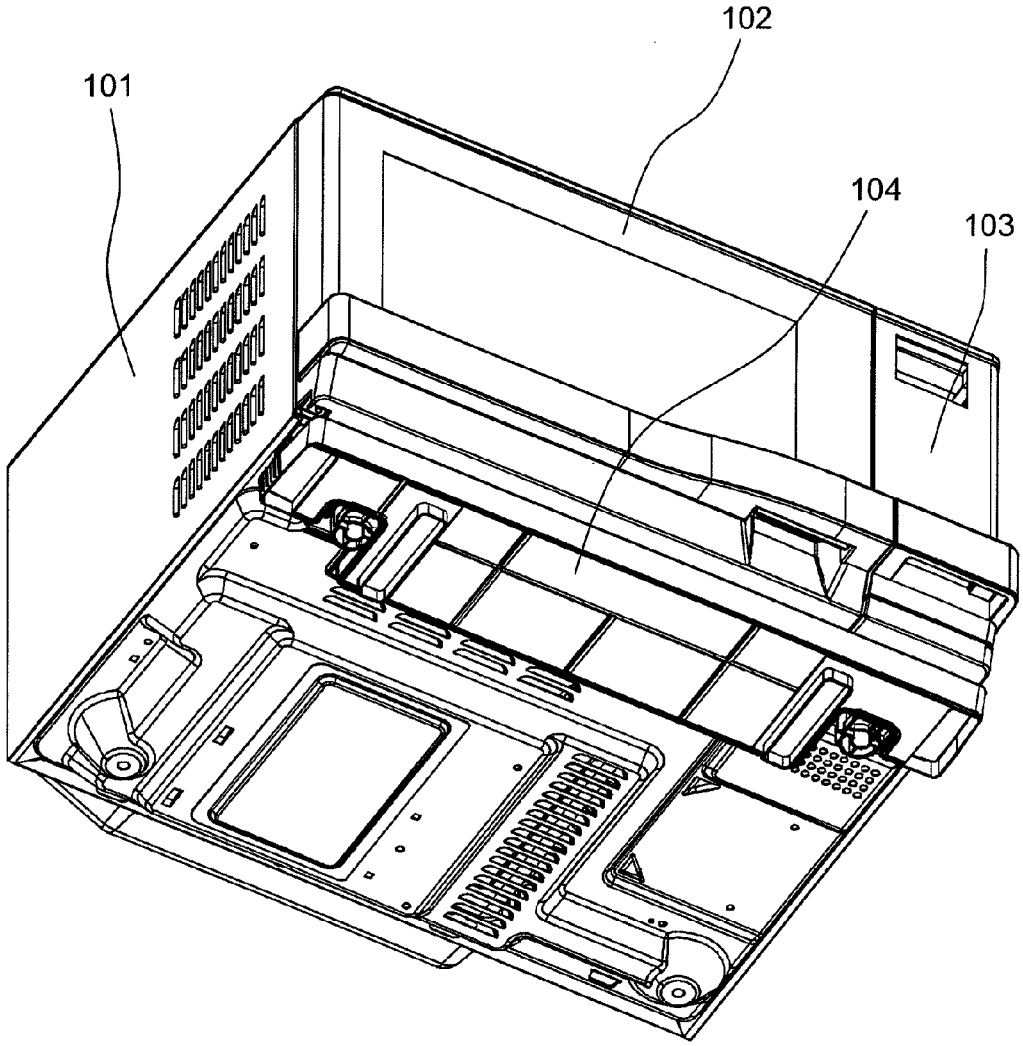
FIG. 21 is a perspective view of the cooking device which is shown in FIG. 20A and on which a dew receiving container is mounted, as seen looking from the front and diagonal lower side.
Figure 22:
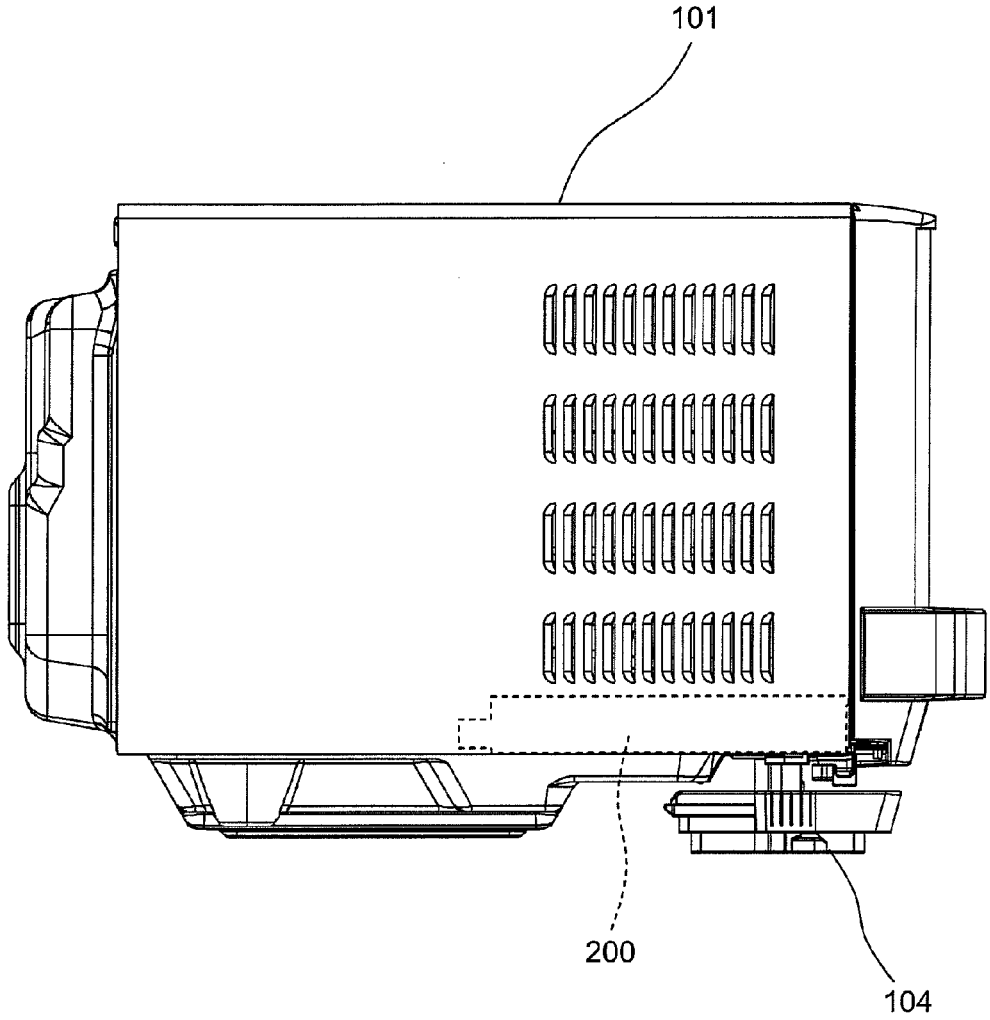
FIG. 22 is a left side view of the cooking device.
Figure 27:
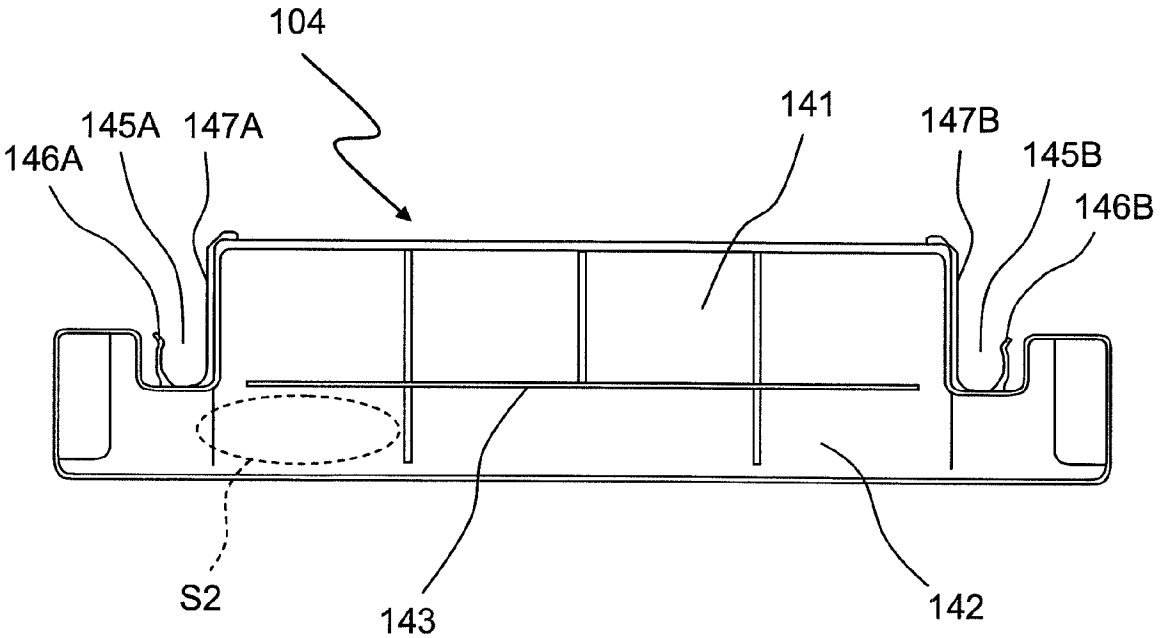
FIG. 27 is a top plan view of the dew receiving container of the cooking device.

By the cut and raised parts 170*b* of the cooling air blow-off openings 170, the portion of the cooling air that flows from the electric component chamber 109 (shown in FIG. 16) on right side through between a bottom face of the heating chamber 108 and the bottom plate 130 toward left side where the exhaust duct 200 (shown in FIG. 19) exists is blown off through the cooling air blow-off openings 170 toward the region S2 facing the discharge ports 204 in the dew receiving container 104 (shown in FIGS. 21, 22, and 27).

FIG. 21 shows a perspective view of the cooking device which is shown in FIG. 20A and on which the dew receiving container 104 is mounted, as seen looking from the front and diagonal lower side. In FIG. 21, the casing 101, the door 102 with handle, and the operation panel 103 are also mounted.

FIG. 22 is a left side view of the cooking device shown in FIG. 21.

Figure 23:
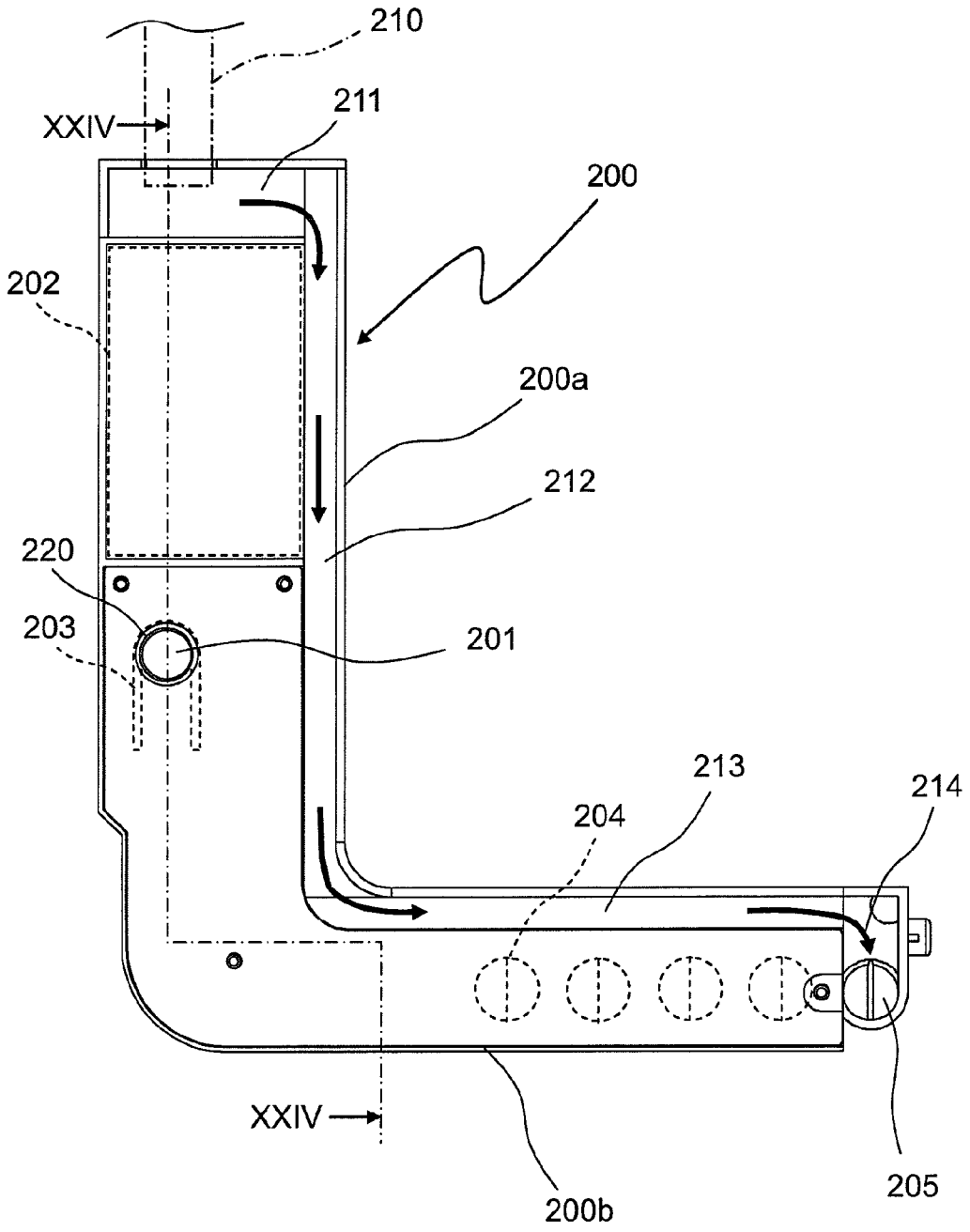
FIG. 23 is a top plan view of an exhaust duct of the cooking device.
Figure 24:
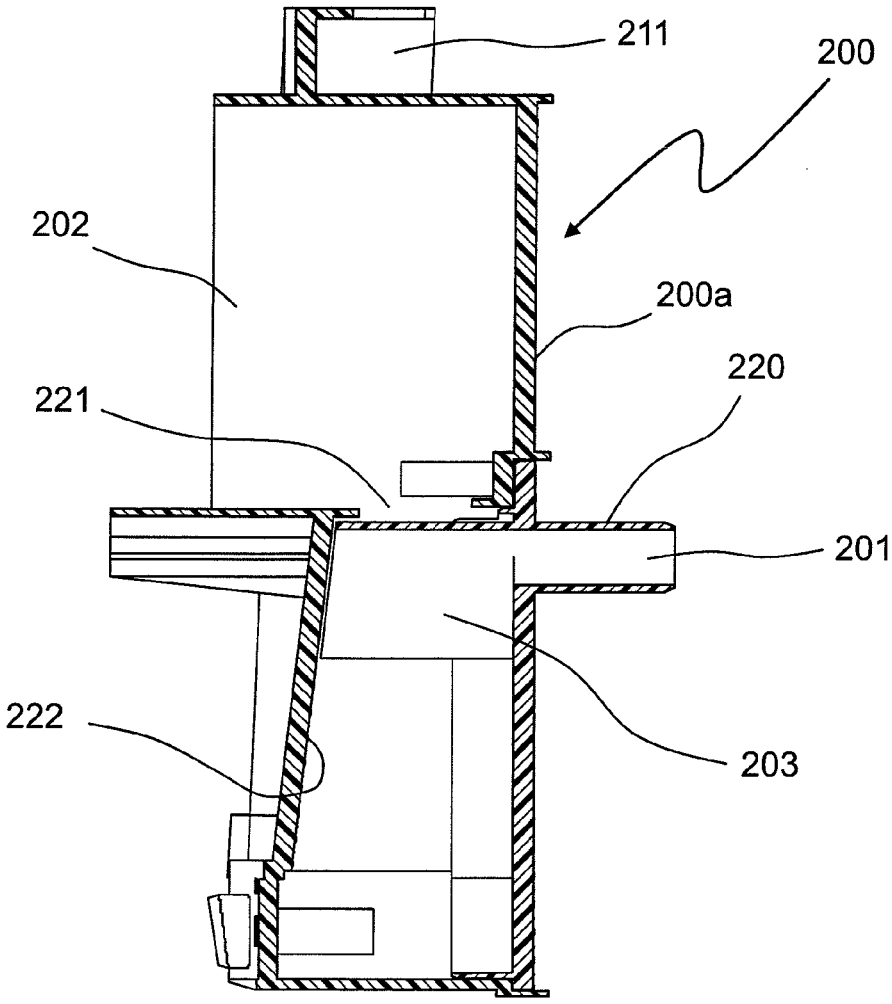
FIG. 24 is a sectional view taken along a line XXIV-XXIV of FIG. 23.
Figure 25:
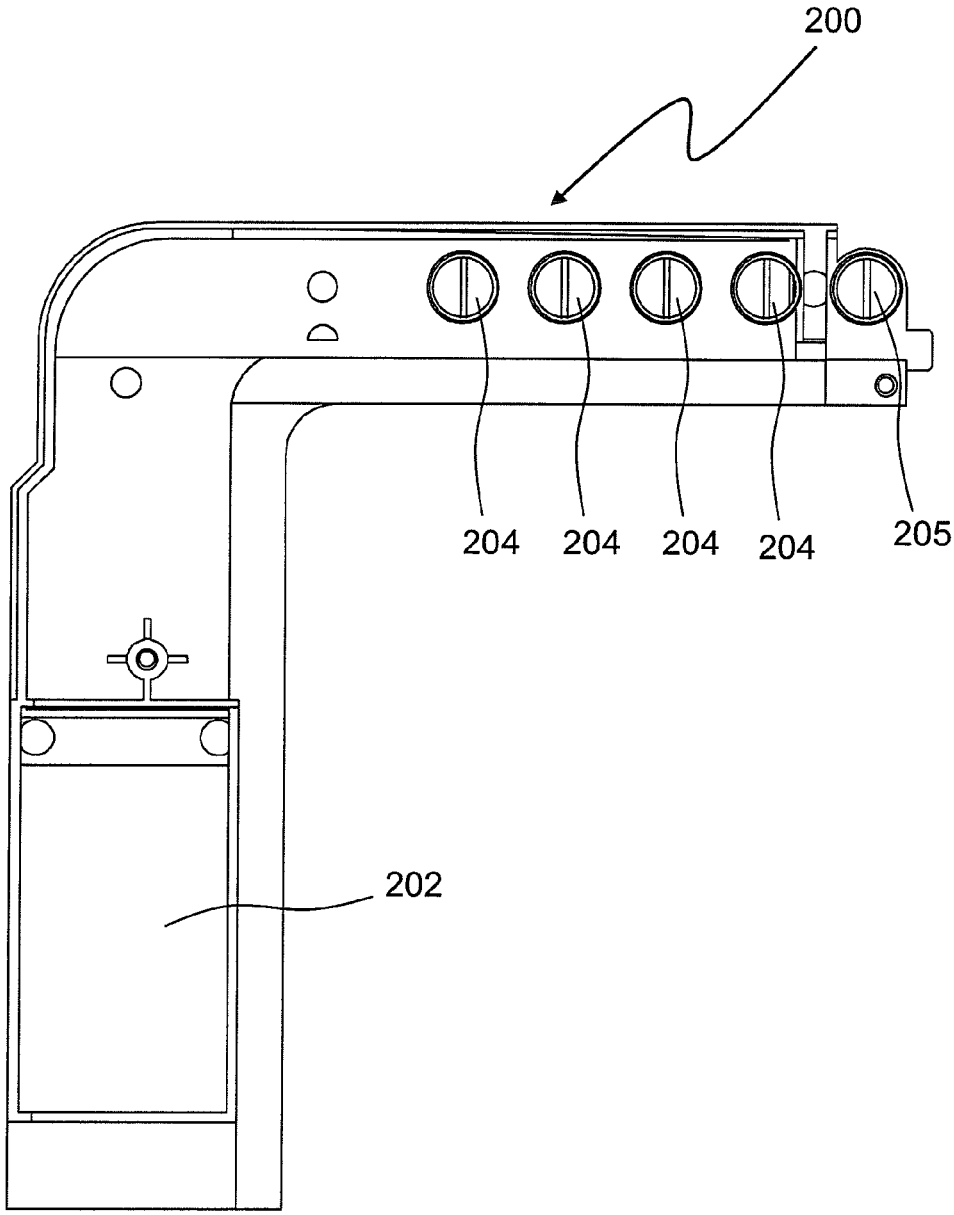
FIG. 25 is a bottom view of the exhaust duct.
Figure 26:
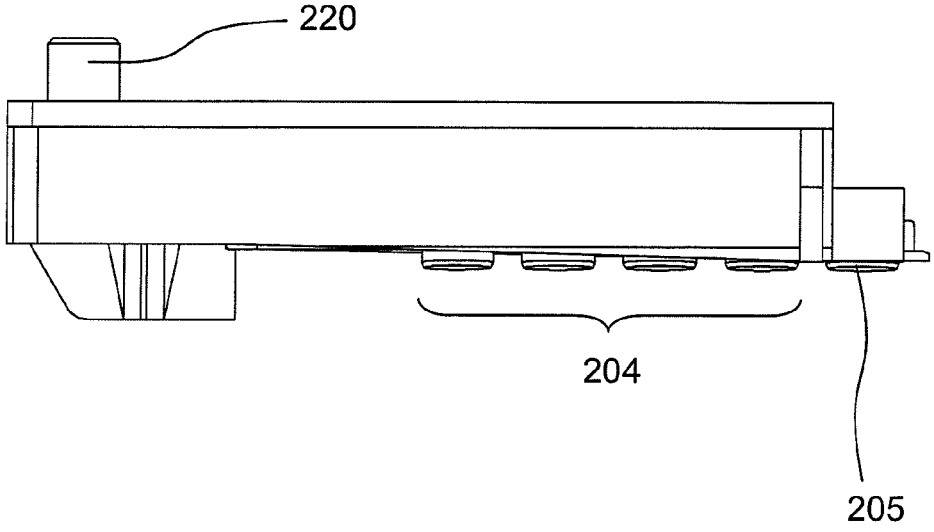
FIG. 26 is a front view of the exhaust duct.

FIG. 23 shows a top plan view of the exhaust duct 200 of the cooking device, FIG. 24 shows a sectional view taken along a line XXIV-XXIV of FIG. 23, FIG. 25 shows a bottom view of the exhaust duct 200, and FIG. 26 shows a front view of the exhaust duct 200.

As shown in FIG. 23, the exhaust duct 200 has a merging part 200*a* on which the exhaust inlet 201 and the cooling air inlet 202 (shown in FIGS. 24, 25) are provided and a stirring discharge part 200*b* which extends rightward at right angles from front face side (lower side in a page of FIG. 22) of the merging part 200*a*. A cylindrical connection part 220 having the exhaust inlet 201 at an extremity thereof is provided on top side of the merging part 200*a* of the exhaust duct 200 so as to stand thereon. A shield wall 203 having a section shaped like a letter U is provided in the exhaust duct 200 so as to surround a region to which the connection part 220 is extended into the exhaust duct 200. The shield wall 203 opens on the front face side (lower side in the page of FIG. 22) thereof.

The four discharge ports 204 are formed at the specified intervals on bottom side of the stirring discharge part 200*b* of the exhaust duct 200.

The drain receiving part 211 to which the extremity part of the drain groove 210 is connected is provided on the rear face side (upper side in a page of FIG. 24) of the merging part 200*a* of the exhaust duct 200. The cooling air inlet 202 is provided on the bottom side (left side in the page of FIG. 24) between the drain receiving part 211 and the exhaust inlet 201. Grooves 212, 213, and 214 are formed on a right side face of the merging part 200*a*, the rear face side and a right side face of the stirring discharge part 200*b*, respectively, on the exhaust duct 200, and the drain opening 205 is formed in the groove 214. Water received by the drain receiving part 211 is guided to the drain opening 205 by the grooves 212, 213, and 214, and is drained through the drain opening 205 into the dew receiving container 104 on underside thereof.

In the merging part 200*a* of the exhaust duct 200, as shown in FIG. 24, an opening part 221 is provided between the cooling air inlet 202 and the connection part 220, and an inclined surface 222 that gradually lowers toward the stirring discharge part 200*b* is provided between the opening part 221 and the stirring discharge part 200*b*. In the bottom part in the stirring discharge part 200*b* also, there is provided an inclined surface that gradually lowers from a side of the merging part 200*a* toward a right end thereof (see FIG. 26). In event that condensate water flows in through the exhaust inlet 201, the condensate water can be guided to the stirring discharge part 200*b* and can be drained through the four discharge ports 204 by the inclined surface 222 in the merging part 200*a* and the inclined surface in the stirring discharge part 200*b*.

In the exhaust duct 200 shown in FIGS. 23 through 26, the exhaust flows from the inside of the heating chamber 108

(shown in FIG. 17) through the exhaust tube 118 (shown in FIG. 17) and the exhaust inlet 201 into the merging part 200*a* of the exhaust duct 200, and a portion of the cooling air that flows from the electric component chamber 109 (shown in FIG. 16) on the right side through between the bottom face of the heating chamber 108 and the bottom plate 130 toward the left side where the exhaust duct 200 (shown in FIG. 19) exists flows through the cooling air inlet 202 into the merging part 200*a* of the exhaust duct 200. Then the cooling air and the exhaust flow to the stirring discharge part 200*b* while being mixed on downstream side (lower side in a page of FIG. 23) of the shield wall 203 in the merging part 200*a* of the exhaust duct 200, are stirred and diluted in the stirring discharge part 200*b*, and are thereafter discharged through the four discharge ports 204 into the dew receiving container 104 below.

Figure 28:
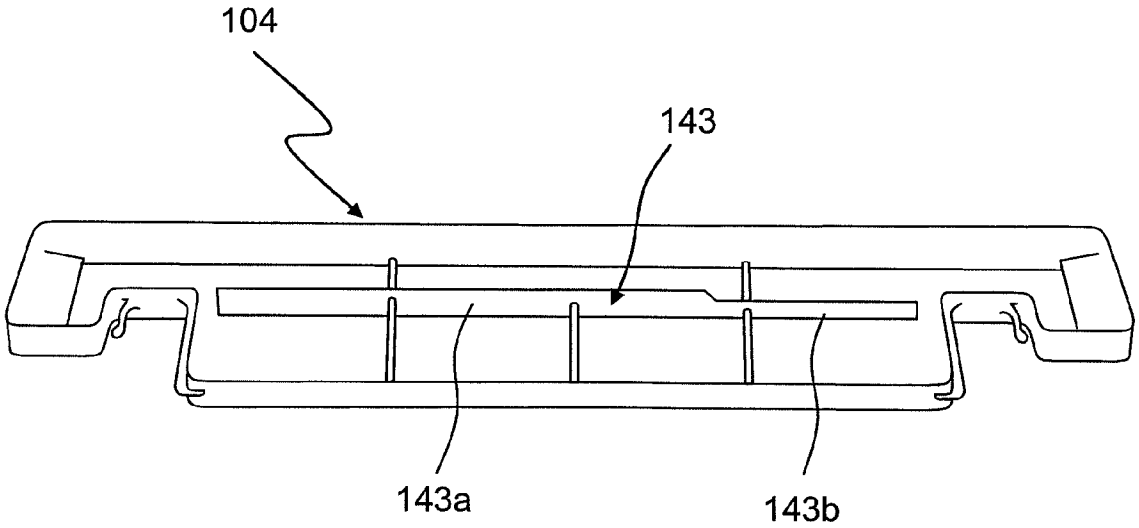
FIG. 28 is a perspective view of the dew receiving container, as seen looking from rear and diagonal upper side thereof.

FIG. 27 shows a top plan view of the dew receiving container 104 of the cooking device, and FIG. 28 shows a perspective view of the dew receiving container 104, as seen looking from rear and diagonal upper side thereof.

As shown in FIGS. 27 and 28, the dew receiving container 104 has a first dew receiving recess 141 in shape of a laterally long rectangle and a second dew receiving recess 142 provided in front of the first dew receiving recess 141, the first dew receiving recess 141 and the second dew receiving recess 142 separated by a rib 143 as an example of a cooling air guiding wall that is provided in the dew receiving container 104. The rib 143 includes a first rib 143*a* and a second rib 143*b* having a height smaller than the first rib 143*a* has. The first rib 143*a* occupies two-thirds on right side (left side in FIG. 28) in general of the rib 143.

The rib 143 is provided as the cooling air guiding wall in the dew receiving container 104 in the second embodiment, whereas the cooling air guiding part is not limited thereto and the cooling air may be guided by other members.

Fitting recesses 145A, 145B that open on the rear face side (upper side in FIG. 27) are provided at both ends of the first dew receiving recess 141, and curved arm parts 146A, 146B that extend toward the rear face side are provided in the fitting recesses 145A, 145B, respectively. Guide parts 147A, 147B are provided on sides facing the first dew receiving recess 141 in the fitting recesses 145A, 145B, respectively.

When the dew receiving container 104 is attached to the two front legs 106, 106 (shown in FIG. 13) provided on the front side on the bottom part of the casing 101, fitting protruding parts (not shown) of the front legs 106, 106 are fitted into the fitting recesses 145A, 145B while being guided by the guide parts 147A, 147B of the dew receiving container 104. Then the curved arm parts 146A, 146B of the dew receiving container 104 undergo elastic deformation and thereby cooperate with the guide parts 147A, 147B to nip the fitting protruding parts (not shown) of the front legs 106, 106, so that the dew receiving container 104 is held by the front legs 106, 106.

The region S2 on the left side in the second dew receiving recess 142 of the dew receiving container 104 faces openings of the discharge ports 204 of the exhaust duct 200 (shown in FIGS. 23 through 26) that resides thereover. Exhaust from the discharge ports 204 of the exhaust duct 200 is received by the region S2 in the second dew receiving recess 142 in the dew receiving container 104 that resides thereunder and is diffused to the outside of the casing 101. Then the exhaust diffuses from inside of the second dew receiving recess 142 in the dew receiving container 104 through a gap between the dew receiving container 104 and the door 102 with handle, a gap between the dew receiving container 104 and the casing 101 and/or the like into a vast outside space on the front face side of the casing 101.

Waterdrops dropping from the drain opening 205 of the exhaust duct 200 are received by the second dew receiving recess 142 in the dew receiving container 104.

The cooling air blown off through the cooling air blow-off openings 170 provided on the bottom part and the front face side of the casing 101 is guided toward the region S2 in the dew receiving container 104 by the rib 143 as the example of the cooling air guiding wall.

In the cooking device having the above configuration, the water supply tank containing a required quantity of water is housed in the tank housing part 115, and heat cooking with use of steam is thereafter started by an operation on the operation panel 103. Then the heater 126 provided on the upper side in the heating chamber 108 is turned on, the water supply pump is activated so as to supply the water in the water supply tank into the steam producing device 113, and steam is produced by heating of the water supplied into the steam producing device 113 by the steam producing heater 124. The steam produced by the steam producing device 113 blows into the heating chamber 108, and becomes superheated steam having a temperature not lower than 100° C. by being heated in the heating chamber 108 by the heater 126. Thus food in the heating chamber 108 is heated and cooked by radiant heat from the heater 126 on the upper side in the heating chamber 108 and by the superheated steam having the temperature not lower than 100° C. Then the superheated steam supplied to and deposited on surfaces of the food condenses on the surfaces of the food and gives the food a great quantity of latent heat of condensation and therefore heat can efficiently be transmitted to the food.

In the cooking device, oven cooking may be performed with use of only the heater 126 and without use of steam, and steam cooking or the like may be performed with use of only steam produced by the steam producing device 113 and without use of the heater 126.

Figure 29:
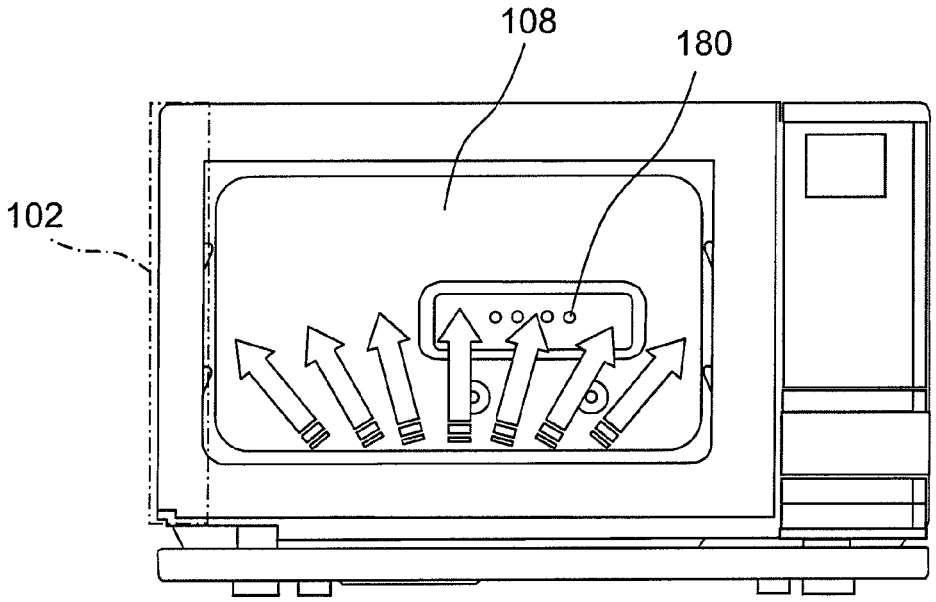
FIG. 29 is a front view of the cooking device with a door with handle opened in heat cooking with use of microwaves.

FIG. 29 shows a front view of the cooking device, with the door 102 with handle opened, in heat cooking with use of microwaves. In the heat cooking with use of microwaves, an object to be heated is placed on bottom part of the heating chamber 108. In FIG. 29, numeral 180 denotes steam blow-off openings through which steam is blown from the steam producing device 113 (shown in FIG. 16) into the heating chamber 108.

Figure 30:
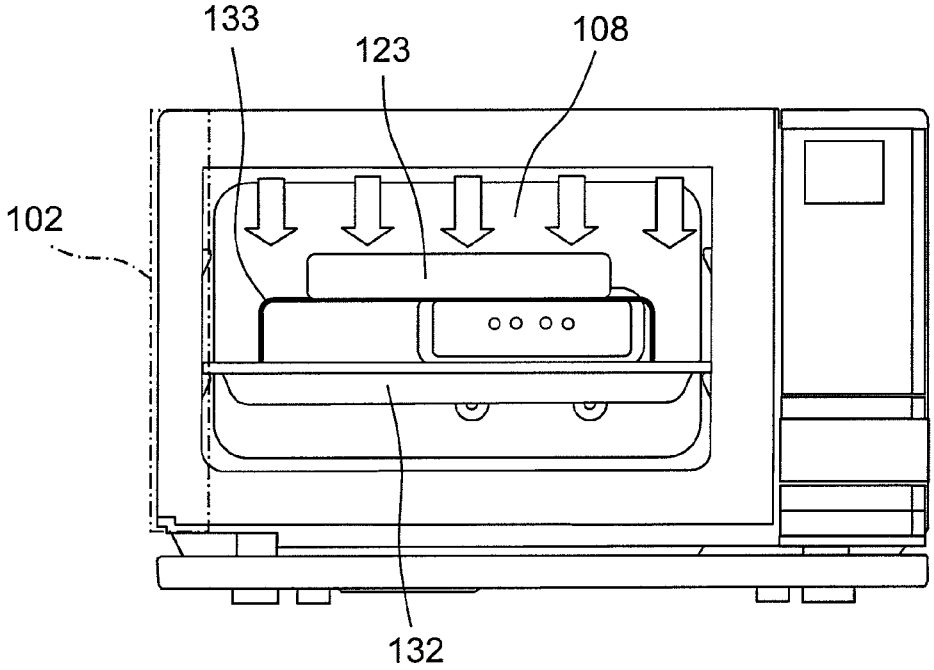
FIG. 30 is a front view of the cooking device in heat cooking of a small piece of food by a heater.

FIG. 30 shows a front view of the cooking device in heat cooking of a small piece of food by the heater 126. In the heat cooking by the heater 126 (shown in FIGS. 15, 16), a tray 132 having a grill 133 placed thereon is inserted into a lower level in the heating chamber 108, and the object 123 to be heated is placed on the grill 133. Thus the object 123 to be heated is heated by the heater 126 placed on the upper side in the heating chamber 108.

Figure 31:
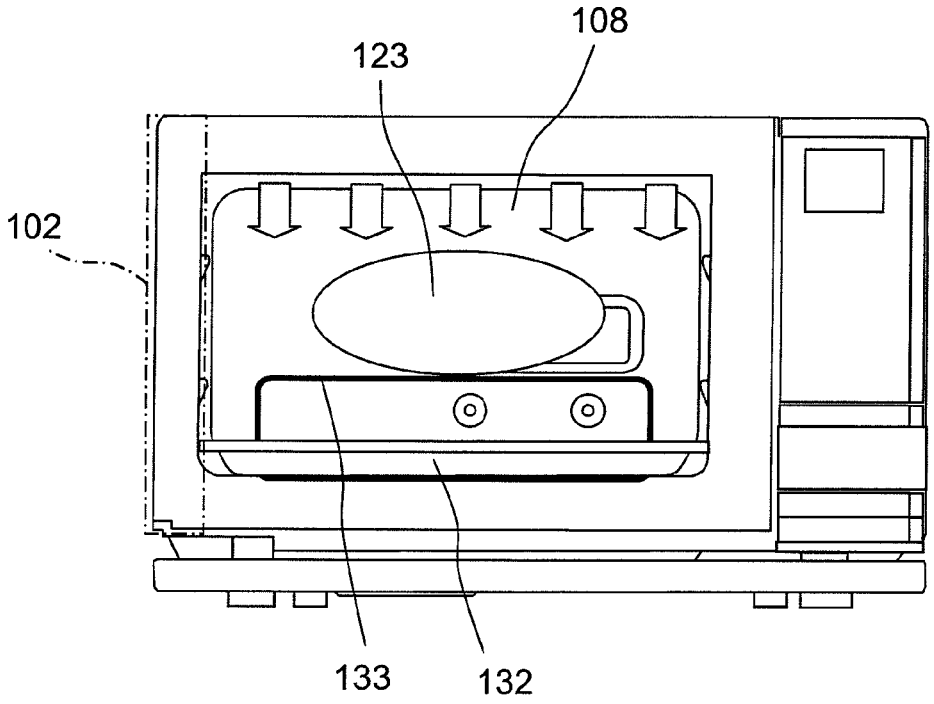
FIG. 31 is a front view of the cooking device in heat cooking of a large piece of food by the heater.

FIG. 31 shows a front view of the cooking device in heat cooking of a large piece of food by the heater 126. In the heat cooking by the heater 126 (shown in FIGS. 15, 16), the tray 132 having the grill 133 placed thereon is placed on the bottom part in the heating chamber 108, and the object 123 to be heated is placed on the grill 133. Thus the object 123 to be heated is heated by the heater 126 placed on the upper side in the heating chamber 108.

Figure 32:
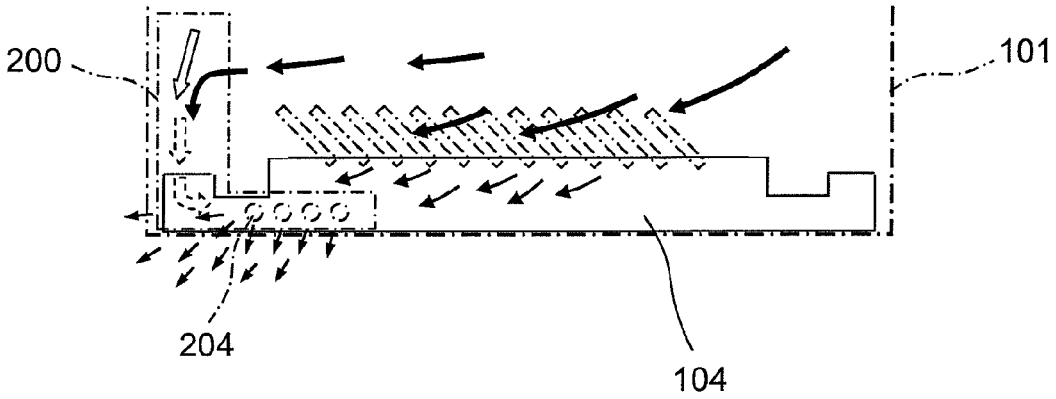
FIG. 32 is a schematic representation for illustrating air flow on front face side and lower side of the cooking device.

FIG. 32 shows a schematic representation for illustrating air flow on the front face side and the lower side of the cooking device. FIG. 32 is the schematic representation as seen looking from above, black arrows denoting the cooling air flowing from the electric component chamber 109 (shown in FIG. 16) on the right side through between the bottom face of the heating chamber 108 and the bottom plate 130 toward the left side where the exhaust duct 200 (shown in FIG. 19) exists, a white arrow defined by solid lines denoting the exhaust from the inside of the heating chamber 108, white arrows defined by dashed lines denoting mixed air. The drain opening 205 is omitted in FIG. 32.

As shown in FIG. 32, the exhaust flows from the inside of the heating chamber 108 (shown in FIG. 17) through the exhaust inlet 201 (shown in FIG. 23) of the exhaust duct 200 into the exhaust duct 200, and the portion of the cooling air that flows from the electric component chamber 109 (shown in FIG. 16) on the right side through between the bottom face of the heating chamber 108 and the bottom plate 130 toward the left side where the exhaust duct 200 (shown in FIG. 19) exists flows through the cooling air inlet 202 (shown in FIG. 23) of the exhaust duct 200 into the exhaust duct 200. The cooling air and the exhaust are mixed in the exhaust duct 200 and are thereafter discharged through the four discharge ports 204 toward the dew receiving container 104 below.

When the heating chamber 108 is increased in temperature and is filled with steam, smoke and/or the like produced from heated food in the heat cooking of the food put in the heating chamber 108, in the cooking device having the configuration, the exhaust from the inside of the heating chamber 108 is guided by the exhaust path (the exhaust tube 118 and the exhaust duct 200) through the inside of the casing 101 to the front face side. The exhaust from the discharge ports 204 of the exhaust duct 200 is received by the dew receiving container 104 provided on the front face side of the casing 101 and is diffused to the outside of the casing 101. Then the highly heated exhaust containing steam from the inside of the heating chamber 108 is cooled when passing through the inside of the casing 101, so that the cooled exhaust having a decreased temperature can be received by the dew receiving container 104 on the front face side and can be diffused to the vast outside space in front of the casing 101.

On condition that there are wall surfaces in vicinity of the rear face side of the cooking device body, shelves just thereover, and/or the like, corrosion, dense growth of mold and/or the like are thereby prevented that might be caused on the wall surfaces, shelves and/or the like by contact therewith of the highly heated exhaust containing steam, because the exhaust in the chamber is not discharged from the rear face side of the body. Under condition of the placement in a narrow space, accordingly, the exhaust from the inside of the heating chamber 108 can be disposed without being discharged from the rear face side.

Means for heating and cooking the object to be heated in the heating chamber 108 is not limited to heating by the heater and may be heat cooking including steam cooking with use of steam and the like or may be heat cooking with use of superheated steam having a temperature not lower than 100° C.

The portion of the cooling air from the cooling fan 116 for cooling at least the electric components in the casing 101 is blown off through the cooling air blow-off openings 170 provided on the bottom part and the front face side of the casing 101 toward the region in the dew receiving container 104 that receives and diffuses the exhaust from the discharge ports 204 of the exhaust duct 200, and the exhaust blown off from the discharge ports 204 of the exhaust duct 200 into the dew receiving container 104 is thereby diluted with the portion of the cooling air while diffusion thereof is promoted, so that the exhaust can efficiently be diffused to the vast outside space on the front face side of the casing 101.

The cooling air blown off through the cooling air blow-off openings 170 provided on the bottom part and front face side of the casing 101 is guided toward the region S2 in the dew receiving container 104 that receives and diffuses the exhaust from the discharge ports 204 of the exhaust duct 200, by the cut and raised parts 170*b* (the cooling air guiding parts) provided in the cooling air blow-off openings 170, and thus the exhaust blown off through the discharge ports 204 of the exhaust duct 200 into the dew receiving container 104 can efficiently be diluted and diffused.

With the cooling air blown off through the cooling air blow-off openings 170 provided on the bottom part and the front face side of the casing 101, the dew receiving container 104 receives the exhaust from the discharge ports 204 of the exhaust duct 200, on the side at left side end of the casing 101 where a center of pivoting of the door 102 with handle exists, and thus a hand that grasps the door 102 with handle being opened is opposed to the center of pivoting of the door 102 with handle, so that the hand that grasps the door 102 with handle is prevented from being exposed to the exhaust diffused by the dew receiving container 104.

The cooling air blown off through the cooling air blow-off openings 170 provided on the bottom part and front face side of the casing 101 is guided toward the region S2 in the dew receiving container 104 that receives and diffuses the exhaust from the discharge ports 204 of the exhaust duct 200, by the rib 143 (cooling air guiding wall) that is provided in the dew receiving container 104, and thus the exhaust blown off through the discharge ports 204 of the exhaust duct 200 into the dew receiving container 104 can efficiently be diluted and diffused.

The exhaust from the inside of the heating chamber 108 is mixed with the other portion of the cooling air from the cooling fan 116 and is discharged into the dew receiving container 104 by the exhaust duct 200 in the casing 101, and thus the dilution of the exhaust and the decrease in the temperature of the exhaust can efficiently be attained with the utilization of the cooling air from the cooling fan 116 for cooling the electric components.

The exhaust tube 118 that is the exhaust path may be extended through the electric component chamber 109 (cooling space) in the casing 101 so as to guide the exhaust from the inside of the heating chamber 108 to the front face side. Thus the path length of the exhaust path can be increased, so that the cooling efficiency can be increased by the extension of the path running through the electric component chamber 109 (cooling space).

The cooking device using the dew receiving container 104 that diffuses the exhaust from the exhaust exit of the exhaust path has been described for the second embodiment, whereas a form of the dew receiving container is not limited thereto and the dew receiving container has only to receive the exhaust from the exhaust exit of the exhaust path and to diffuse the exhaust to the outside of the casing.

The cooking device that discharges the exhaust from the inside of the heating chamber 108 through the exhaust tube 118 and the exhaust duct 200 that are the exhaust path into the dew receiving container 104 that is the exhaust receiving part has been described for the second embodiment, whereas the exhaust from the inside of the heating chamber may be discharged through an exhaust path into the exhaust receiving part without use of the exhaust duct.

Though the opening 108*c* of the heating chamber 108 is opened and closed by the door 102 with handle that pivots in lateral directions with respect to the casing 101 in the second embodiment, whereas the door which the cooking device of the invention includes may be of slide type or pivoting type.

As the cooking device of the invention, there may be used not only a microwave oven using superheated steam but an oven using superheated steam, a microwave oven not using superheated steam, an oven not using superheated steam or the like, for instance.

In the cooking device of the invention, healthy cooking can be performed by use of superheated steam or saturated steam in a microwave oven or the like. In the cooking device of the invention, for instance, superheated steam or saturated steam having a temperature not lower than 100° C. is supplied onto surfaces of food, the superheated steam or saturated steam deposited onto the surfaces of the food condenses and gives the food a great quantity of latent heat of condensation, and therefore heat can efficiently be transmitted to the food. The condensate water is deposited on the surfaces of the food, and salt content, oil content and the like drop with the condensate water, so that salt content, oil content and the like in the food can be reduced. Furthermore, the heating chamber is filled with the superheated steam or saturated steam so as to be poor in oxygen, and thus cooking by which oxidation of the food is suppressed can be performed. Herein, a condition poor in oxygen refers to a condition in which volume percentage of oxygen is not more than 10% (e.g., between 2 and 3%) in the heating chamber.

Though the specific embodiments of the invention have been described, the invention is not limited to the first and second embodiments described above and can be embodied with modification in various ways within the scope of the invention.

REFERENCE SIGNS LIST

1 casing
2 door with handle
3 operation panel
4 dew receiving container
5 dial
6 front leg
7 liquid crystal display part
8 heating chamber
8*a* opening
9 electric component chamber
10 air intake space
11 heat shield plate
13 steam producing device
14 water supply pump
15 tank housing part
16 cooling fan
17 air intake
18 exhaust tube
19 exhaust duct
20 water supply tube
21 partition wall
22 discharge port
23 water supply tank
24 steam producing heater
25 upper heater housing part
26 upper heater
31 rail unit
32 tray
40 shield member
41 bottom part
41*a* cylinder part
41*b* recessed part
42 side wall part
101 casing
102 door with handle
103 operation panel
104 dew receiving container
106 front leg
107 liquid crystal display part
108 heating chamber
108*a* air supply opening
108*b* exhaust opening
108*c* opening
109 electric component chamber
110 air intake space
111 heat shield plate
113 steam producing device
115 tank housing part
116 cooling fan
117 air intake
118 exhaust tube
121 partition wall
123 object to be heated
124 steam producing heater
126 heater
130 bottom plate
132 tray
133 grill
143 rib
151 magnetron
170 cooling air blow-off opening
170*a* slit part
170*b* cut and raised part
200 exhaust duct
200*a* merging part
200*b* stirring discharge part
201 exhaust inlet
202 cooling air inlet
203 shield wall
204 discharge port
210 drain groove
211 drain receiving part
212, 213, 214 groove
205 drain opening
220 connection part

The invention claimed is:

1. A cooking device comprising:

a casing of a rectangular parallelepiped shape;

a heating chamber of a rectangular parallelepiped shape that is provided in the casing and that has an opening on a front face thereof, wherein an object to be cooked is taken out of and put into the heating chamber through the opening of the heating chamber;

a door which opens and closes the opening of the heating chamber;

a steam producing device which is provided in the casing and produces steam that is supplied into the heating chamber;

a dew receiving container of a top-opened shape that is placed outside and under the casing and placed under the door closed and the opening of the heating chamber, and that has a dew receiving recess for receiving waterdrops dropping along a rear face of the door and a front face of the casing; and an exhaust path which passes inside of the casing and passes through a bottom plate of the casing, and in which gas supplied from inside of the heating chamber flows, wherein an exhaust exit of the exhaust path faces the dew receiving recess of the dew receiving container such that the exhaust exit of the exhaust path discharges the gas supplied from inside of the heating chamber toward the dew receiving recess of the dew receiving container.

2. The cooking device as claimed in claim 1, further comprising:

a cooling fan for cooling at least electric components in the casing; and cooling air blow-off openings that are provided on a bottom part of the casing and that blow off a portion of cooling air supplied from the cooling fan toward a region in the dew receiving container.

3. The cooking device as claimed in claim 2, further comprising:

cooling air guiding parts provided between the cooling fan and the cooling air blow-off openings that guide the cooling air to be blown off from the cooling air blow-off openings toward a region in the dew receiving container that receives and diffuses the exhaust from the exhaust exit of the exhaust path.

4. The cooking device as claimed in claim 2, wherein the door is provided on the front face side of the casing and opens or closes the opening of the heating chamber by pivoting on either one of left and right side end parts of the casing, wherein the dew receiving container receives the exhaust from the exhaust exit of the exhaust path on either one of left and right sides of the casing where a pivoting center of the door exists, and wherein the cooling air blown off from the cooling air blow-off openings is blown off toward either one of the left and right sides of the casing where the pivoting center of the door exists.

5. The cooking device as claimed in claim 2, further comprising:

a cooling air guiding wall provided in the dew receiving container for guiding the cooling air blown off from the cooling air blow-off openings toward the region in the dew receiving container that receives and diffuses the exhaust from the exhaust exit of the exhaust path.

6. The cooking device as claimed in claim 2, further comprising an exhaust duct that is provided on an exhaust exit side in the exhaust path in the casing and that mixes the exhaust from the inside of the heating chamber with the portion of the cooling air from the cooling fan and discharges the exhaust into the dew receiving container.

7. The cooking device as claimed in claim 2, further comprising an exhaust duct provided in the casing and on a front face side in a cooling space, and a cooling fan for cooling at least electric components in the cooling space, wherein the exhaust duct comprises a blow-in opening, provided on upstream side thereof, into which a portion of cooling air from the cooling fan is blown, and a discharge port, provided on downstream side thereof, through which the cooling air blown in through the blow-in opening is discharged, wherein the exhaust exit of the exhaust path is provided in an air path between the blow-in opening and the discharge port, and wherein the exhaust from the exhaust exit of the exhaust path is received by the dew receiving container through the discharge port of the exhaust duct.

8. The cooking device as claimed in claim 1, wherein the exhaust path guides the exhaust from the inside of the heating chamber through a cooling space in the casing to the front face side of the casing.

9. The cooking device as claimed in claim 8, wherein the exhaust path is inclined from a rear part of the heating chamber toward the front face side of the casing and from an upper side of the rear part of the heating chamber toward a lower side of the front face side of the casing.

10. The cooking device as claimed in claim 8, wherein the cooling space is provided so as to extend from a lateral side and the rear face side of the heating chamber to the front face side of the casing, and wherein the exhaust path guides the exhaust from a vicinity of a rear part of the heating chamber toward the front face side and the outside of the casing in the cooling space.

11. The cooking device as claimed in claim 1, comprising a door that is openably and closably provided on a front face of the casing and that opens or closes the opening of the heating chamber, wherein the dew receiving container receives waterdrops dropping from the front face of the casing.

* * * * *